US006059928A

United States Patent [19]

Van Luu et al.

[11] Patent Number: 6,059,928

[45] **Date of Patent: *May 9, 2000**

[54] PREWETTABLE HIGH SOFTNESS PAPER PRODUCT HAVING TEMPORARY WET STRENGTH

[75] Inventors: Phuong Van Luu; Gary Worry, both of Appleton; Robert J. Marinack, Oshkosh; Henry S. Ostrowski, Appleton; Dinesh M. Bhat, Neenah, all of Wis.

[73] Assignee: Fort James Corporation, Deerfield, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/530,489

[22] Filed: Sep. 18, 1995

[51] Int. Cl.[7] ..... D12H 21/14

[52] U.S. Cl. ..... 162/111; 162/112; 162/113; 162/123; 162/129; 162/130; 162/131; 162/158; 162/164.6; 162/168.2; 162/175; 162/179

[58] Field of Search ..... 162/111, 112, 162/123, 129, 130, 131, 158, 179, 175, 164.6, 168.2

[56] References Cited

U.S. PATENT DOCUMENTS

| | | | |
|---|---|---|---|
| 1,546,211 | 7/1925 | Dreyfus . | |
| 1,816,973 | 8/1931 | Kantorowicz . | |
| 1,857,263 | 5/1932 | Sponsel et al. . | |
| 2,203,492 | 6/1940 | Evans et al. . | |
| 2,285,490 | 6/1942 | Broderick . | |
| 2,322,888 | 6/1943 | Schwartz et al. . | |
| 2,436,076 | 2/1948 | Pfeffer, Jr. et al. . | |
| 2,622,960 | 12/1952 | Woods et al. . | |
| 2,826,514 | 3/1958 | Schroeder . | |
| 3,096,228 | 7/1963 | Day et al. | 162/111 |
| 3,301,746 | 1/1967 | Sanford et al. | 162/117 |
| 3,312,521 | 4/1967 | Stenner . | |
| 3,317,370 | 5/1967 | Kekish . | |
| 3,556,932 | 1/1971 | Coscia et al. . | |
| 3,556,933 | 1/1971 | Williams et al. . | |
| 3,597,313 | 8/1971 | Williams et al. . | |
| 3,755,220 | 8/1973 | Freimark et al. . | |
| 3,798,122 | 3/1974 | Appel et al. . | |
| 3,798,123 | 3/1974 | Appel | 162/111 |
| 3,810,783 | 5/1974 | Bomball . | |
| 3,821,068 | 6/1974 | Shaw . | |
| 3,837,999 | 9/1974 | Chung | 162/111 |
| 3,918,903 | 11/1975 | Kullman et al. . | |
| 4,112,167 | 9/1978 | Dake et al. . | |
| 4,117,187 | 9/1978 | Adams et al. . | |
| 4,164,595 | 8/1979 | Adams et al. . | |
| 4,191,609 | 3/1980 | Trokhan . | |
| 4,233,411 | 11/1980 | Ballweber et al. . | |
| 4,269,603 | 5/1981 | Worth . | |
| 4,447,294 | 5/1984 | Osborn, III . | |
| 4,537,807 | 8/1985 | Chan et al. . | |
| 4,603,176 | 7/1986 | Bjorkquist et al. . | |
| 4,605,702 | 8/1986 | Guerro et al. . | |
| 4,625,029 | 11/1986 | Floyd et al. . | |
| 4,666,750 | 5/1987 | Hammer et al. . | |
| 4,675,394 | 6/1987 | Solarek et al. . | |
| 4,695,606 | 9/1987 | Floyd et al. . | |
| 4,703,116 | 10/1987 | Solarek et al. . | |
| 4,720,383 | 1/1988 | Drach et al. . | |
| 4,731,162 | 3/1988 | Solarek et al. . | |
| 4,741,804 | 5/1988 | Solarek et al. . | |
| 4,788,280 | 11/1988 | Billmers et al. . | |
| 4,804,769 | 2/1989 | Solarek et al. . | |
| 4,849,054 | 7/1989 | Klowak . | |
| 4,866,151 | 9/1989 | Tsai et al. . | |
| 4,981,557 | 1/1991 | Bjorkquist . | |
| 4,983,748 | 1/1991 | Tsai et al. . | |
| 5,008,344 | 4/1991 | Bjorkquist . | |
| 5,059,282 | 10/1991 | Ampulski et al. . | |
| 5,085,736 | 2/1992 | Bjorkquist . | |
| 5,138,002 | 8/1992 | Bjorkquist . | |
| 5,217,576 | 6/1993 | Van Phan | 162/111 |
| 5,223,096 | 6/1993 | Phan et al. . | |
| 5,240,562 | 8/1993 | Phan et al. | 162/111 |
| 5,246,546 | 9/1993 | Ampulski . | |
| 5,330,622 | 7/1994 | Hemmerat et al. . | |
| 5,405,501 | 4/1995 | Phan et al. | 162/130 |

FOREIGN PATENT DOCUMENTS

| | | |
|---|---|---|
| 1279145 | 6/1986 | Canada . |
| 0 672 787 A2 | 9/1995 | European Pat. Off. . |
| 0 672 787 A3 | 7/1996 | European Pat. Off. . |

OTHER PUBLICATIONS

Hoke, Stephen et al., "A New Fugitive Wet Strength Resin," from 1985 Papermakers Conference, pp. 23–30.

"Glyoxal", brochure published by Societe Francaise Hoechst, undated Hurwitz, Melvin D. et al, "Dialdehydes as Cotton Cellulose Cross–Linkers", Textile Research Journal, Mar. 1958, pp. 257–262.

(List continued on next page.)

*Primary Examiner*—Peter Chin

*Attorney, Agent, or Firm*—Finnegan, Henderson, Farabow, Garrett & Dunner, L.L.P.

[57] ABSTRACT

A paper product and a method of making a paper product with a glabrous surface and adapted for use either dry or for use in a manually pre-moistened condition. The paper product having temporary wet strength exhibiting an initial normalized CD wet tensile strength of at least about 75 g/3 inch strip, preferably 105 g/3 inch strip as measured by the Finch Cup Test 5 seconds after immersion and a subsequent CD wet strength of less than ½ as measured 10 minutes after immersion. A temporary wet strength agent comprising uncharged chemical moieties such as aldehydes, and aldehydes containing polymers, polyols and cyclic ureas or mixtures thereof in the range of from about 2 pounds per ton to about 30 pounds per ton is added to the web. Optionally starch and a cationic nitrogenous softener/debonder is added. The starch and softener/debonder are added to assist in tailor making the desired paper product having temporary wet strength. The dry CD tensile strength of the paper product is from at least about 399 g/3 inches up to about 801 g/3 inches, and the tensile modulus is from about 10 to about 32 g/% strain while the GM MMD friction is from about 0.26 to about 0.10. When rubbed against a skin-like surface in a moistened condition, the paper product remains substantially free of pilling.

100 Claims, 17 Drawing Sheets

OTHER PUBLICATIONS

Buttrick, G.W. et al., "Improving the Wet Rub Resistance of Starch–Clay Paper Coatings with Glyoxal", Tappi, vol. 45. No. 11, 11/62, pp. 890–893.

Eldred, N.R., et al., "Glyoxal: A Unique Wet–Strength Agent," Tappi, vol. 46, No. 10, Oct. 1963, pp. 608–612.

Kleigman, Jonathan M., et al., "Glyoxal Derivatives. V. Reaction of Alcohol with Glyoxal," J. Org. Chem, vol. 38, No. 3, 1973, pp. 556–560.

Kleigman, Jonathan M., "Glyoxal Derivatives. VI. The Formation of Glycolates and the Acid–catalyzed Decomposition of Glyoxal Acetals," J. Org. Chem, vol. 39. No. 12, 1974, pp. 1772–1776.

Welch, Clark M., et al. "Glyoxal as a Non–Nitrogenous Formaldehyde–Free Durable–Press Reagent for Cotton," 1982 Textile Research Institute, Feb. 1982, pp. 149–157.

Yamamoto, Kazahide, "Crease–Resistance Treatments of Cotton Fabrics with Non–formaldehyde Crosslinking Agents," 1982 *Textitle Research Institute,*Jun. 1982, pp. 357–362.

Welch, Clark M., "Glyoxal as a Formaldehyde–Free Durable Press Reagent for Mild Curing Applications," Textile Research Journal, Mar. 1983 pp. 181–186.

Mattioda, G., et al., "What you can do with glyoxal," Chemtech Aug. 1983 pp. 478–481.

Sangsari, Farid Hamedi, et al., "Competitive hemiacetalization and acetalization: cross–linking of cellulose by glyoxal," Recl. Trav. Chim., Pays–Bas 109, 419–424 (1990).

Sangsari, Farid Hamedi, et al., "The acetalization of glyoxal by vicinal diols," Recl Trav. Chim. Pays–Baas 109, 15–20 (1990).

Bertoniere, Noelie R., et al., "Pore Structure of Cotton Fabrics Cross–linked with Formaldehyde–Free Reagents," Textile Res. J., 349–356 (1992).

Shyu, Jyh–Pyng, "Properties of Cotton Fabrics Crosslinked with Different Molecular Chain Lengths of Aldehyde Agents," Textile Res. J. 62(8), 469–474 (1992).

Dialog Search, "Glyoxal or Formaldehyde as Crosslinking Agents," 73 items.

Guette, J.P., Glyoxal: A Very Useful Molecule, [English Abstract of a French Article].

PREWETTABLE HIGH SOFTNESS PAPER PRODUCT HAVING TEMPORARY WET STRENGTH

FIELD OF THE INVENTION

The present invention relates to a prewettable paper product having temporary wet strength. The present invention further relates to a soft, strong, flushable, dispersible and biodegradable paper product having temporary wet strength which may be premoistened before use and resists pilling and shredding when used premoistened. More particularly, the invention relates to a high softness tissue product having temporary wet strength, thereby rendering it prewettable.

BACKGROUND OF THE INVENTION

Bathroom tissue must reconcile several conflicting properties: bath tissue must be strong, soft, flushable, dispersible and degradable. Achieving desirable combinations of these properties at an economically viable cost is a considerable challenge.

However, adding resistance to wet abrasion as an additional and conflicting property to those previously mentioned, poses an even tougher technical challenge. Construction of a tissue which has sufficient wet strength so that it can be used premoistened, inherently conflicts not only with flushability and dispersibility, but also with retaining sufficient softness to be used either premoistened or dry.

In order to provide a household bathroom tissue which is acceptable to consumers, it is necessary to provide a soft tissue which has sufficient dry tensile strength for normal use. In addition, it is necessary that the tissue is sufficiently dispersible for flushing, in reasonable quantities, in typical household toilets, while providing a tissue with sufficient degradability to be accommodated in septic systems. Conventional bathroom tissue does not possess sufficient resistance to wet abrasion to be suitable for use premoistened without tending to pill or shred.

Usually, cleansing of the perineum and adjacent regions of the human body is performed with bathroom tissue in a dry condition. Dry tissue does not always cleanse these regions as thoroughly as may be desired. Some users would prefer to use a bidet to assist with the cleansing of these regions for a feeling of extra cleanliness. However, if an individual uses conventional bathroom tissue after the perineum and adjacent regions are thoroughly wet or proceeds to moisten the tissue prior to use of the tissue, known bath tissues, even those few brands having significant wet strength to retain some reasonable structure, have a tendency to pill.

Pilling is a phenomenon occurring during use wherein small balls of tissue cling either to the surface of the tissue or to the user, possibly leading the tissue to shred before cleaning is complete. Such a condition is not desirable to most users. One purpose of this invention is to provide a flushable, sewer and septic-compatible tissue product which may be moistened before use and still retain sufficient softness, strength and resistance to pilling to be used in cleaning.

One manner of adding wet strength to a product is to add "permanent" wet strength. Permanent wet tensile strength would normally interfere with both the dispersibility and degradability of the product and thus prevent the tissue from being compatible with a septic system. In addition, permanent wet tensile strength can often interfere with the flushing of the tissue in a typical household toilet, either by clogging the bowl or by being retained within the pipeline connecting the house to the sewer, thus causing clogging, particularly, as is often the case in older homes, when tree roots are present.

Conventionally, wet tensile strength is obtained in a paper product by adding, to the paper furnish, a permanent wet strength resin or agent, such as the polyamide epichlorohydrin resins sold by Hercules under the trademark KYMENE®. At least two mechanisms by which wet strength resins act have been postulated. One holds that wet strength resins form covalent bonds between adjacent fibers, while another holds that wet strength resins form a water resistant network over the hydrogen bonds formed between adjacent paper fibers, thus preventing water from breaking the hydrogen bonds. In a permanent wet strength product, the strengthening effect does not decay with time. Accordingly, paper products produced with permanent wet strength resins would not normally be acceptable for use in a conventional household toilet or for use with a septic system.

An alternative to providing permanent wet strength is to provide a temporary wet strength. To provide temporary wet strength, specialized temporary wet strength resins are incorporated into a cellulosic web. The nature of the resin chosen does not seem to be critical provided it contains aldehyde moieties and provides wet strength properties as described herein. Suitable products are usually water soluble aldehyde moiety containing polyols, monomers, cyclic ureas and mixtures of these. Typically, these chemical moieties are dialdehydes or water soluble organic polyols comprising aldehydic units. Although wishing not to be bound by any theory, it is thought that these polymers or aliphatic dialdehydes form hemiacetal linkages with the cellulose and that these hemiacetal linkages hydrolyze at a moderate rate when immersed in water, so tissues incorporating these resins have considerable initial wet strength, but after only a few minutes, the wet strength drops to some suitably low value to make the tissue flushable.

In practice, the initial wet strength of tissues made using these wet strength agents tends to increase moderately over the first several days subsequent to manufacture thereof. In our experience, wet strength tends to be fairly well leveled out within about a week after manufacture, so throughout this specification and claims, where we refer to wet strength, that wet strength should be understood to be wet strength as obtained after about a week of aging unless the context clearly indicates otherwise.

U.S. Pat. Nos. 3,096,228 and 2,622,960 disclose the use of glyoxal to improve the wet strength of paper products. The conditions under which glyoxal is applied to the web in these relatively old references tend to produce products which do not meet the five properties set forth for the tissue of this invention.

In U.S. Pat. No. 2,622,960 to Woods et al., paper is obtained by saturating a preformed and dryed sheet by immersion or spraying with an aqueous solution of glyoxal and subsequently heating the treated sheet at a temperature of at least 212° F. This process has disadvantages when employed in the manufacture of toilet tissue, facial tissue, and light weight single ply towels since it tends to embrittle these light weight paper products causing a loss in tear strength of the web. These disadvantages are discussed in the prior art reference, Day et al. U.S. Pat. No. 3,096,228.

In order to address the shortcomings of Woods et al., Day et al. discloses a process for adding glyoxal to a dry absorbent paper web, having a moisture content of about 3 to 7% by weight based on the weight of bone dry paper, so that the final moisture content of the web is more than 4% and not more than 20% by weight. By storing the paper at this moisture content at room temperature, wet tensile strength is developed in the web by migration of glyoxal throughout the web. Consequently, paper rolls must be stored at least one day before converting in order to develop sufficient product wet tensile strength, or paper rolls must be converted into product form under mill condition such that initial web moisture content is maintained in the converted product package for at least 24 hours. In either case, logistical and/or environmental problems arise in the paper mill. Furthermore, the high moisture levels usually greater than or equal to 8–10% required in U.S. Pat. No. 3,096,228 to Day et al. tends to relax the stretch in a creped web (i.e. cause stretch pullout) and weaken the web, making converting on modern continuous winders difficult or impractical.

The present invention clearly distinguishes over these prior art references by the application of uncharged chemical wet strength agents before or after the Yankee pressing roll (16) to a wet fibrous web and thereafter drying and creping said web. This process leads to an unexpected enhanced temporary wet strength absorbent product without the negative aspect of requiring chemical migration by storage at high humidity levels. Without being bound by theory, we believe the addition of uncharged chemical wet strength agents to a web before and/or after a papermachine Yankee pressure roll allows for chemical migration within the sheet—ultimately enhancing wet tensile strength.

The hydraulic spray units utilized in U.S. Pat. No. 3,096,228 when applied to a dry sheet according to the procedure disclosed in that prior patent, will produce nonuniform paper products, particularly when glyoxal is sprayed before embossing. This procedure tends to lead to glyoxal build up on the finished rolls creating additional processing problems.

While at least one brand of commercially available bath tissue possesses some degree of temporary wet strength, it appears that the manufacturer's purpose in including temporary wet strength in those products may be to counter the effects of the wetting which occurs during normal use. Merely adding a temporary wet strength agent to this tissue does not render it suitable for use in a premoistened condition. When attempts are made to use this tissue after premoistening, the tissue "shreds" and "pills" quite severely. Thus, rather than providing enhanced cleaning, attempted use of these products in a premoistened condition often leaves considerable detritus of shreds and pills of paper on the area that was to be cleaned. When the area to be cleaned is covered in this detritus of shreds and pills, the purpose of premoistening the tissue is largely lost.

Unlike prior art tissues, the present invention provides a tissue which (i) has sufficient wet strength and resistance to wet abrasion so that it can be used premoistened; (ii) is flushable; (iii) is dispersible and biodegradable; (iv) has dry strength comparable to premium bath tissue; and (v) has softness comparable to modern premium bath tissue.

The tissue of the present invention reconciles these conflicting objectives by providing a tissue having a glabrous surface coupled with an initial normalized temporary wet strength of at least about 75 g/3 inches, preferably about 105 grams/3 inches as measured using the Finch Cup method for an 18.5 lb/3000 sq ft ream. The tissue of the present invention further exhibits a wet-to-dry CD (Cross Direction) tensile strength ratio of at least about 18%, preferably over 20%. Temporary wet strength is provided by use of a temporary wet strength chemical moiety added to the web, before the pressing roll (16) on the air side of the sheet, after the pressing roll (16) or on the Yankee (26) surface. This moiety generally has no charge and therefore is applied after the web has been formed. The chargeless chemical moiety includes aldehydes, aldehyde containing polyols, polymers, cyclic ureas and mixtures of these and can be used in combination with cationic starches, and optionally, a cationic softener/debonder to create a prewettable high softness tissue or towel having the desired physical parameters. A softener/debonder can be used directly with the chargeless aldehydes, and chargeless aldehyde containing polyols, polymers, cyclic ureas, and mixtures of these or they can be used in combination with the cationic starches. In this invention the primary wet strength agents are the uncharged aldehydes, and the uncharged aldehyde containing polyols, polymers and cyclic ureas or mixtures of these. The starches and softeners/debonders are utilized to obtain specific properties for certain specialized applications.

In our process the wet strength and dry strength can be controlled independently by balancing the amount of chargeless chemical moieties added to the web with the cationic strength enhancing agents added to the furnish. To further fine tune our system, we optionally utilize cationic softeners/debonders. These can be added to the furnish after the starch has been mixed with the furnish or sprayed on the web before or after the pressing roll. In our process cationic softeners/debonders need not be used if cationic strength enhancing agents such as starch have not been added to the furnish. In some instances, we use the chargeless chemical moieties in combination with cationic softeners/debonders, this combination functions as a temporary wet strength agent.

Simply adding a quantity of temporary wet strength resins to conventional furnishes for tissue does not guarantee that the product will be well suited for use premoistened. The present inventors have found that when the tissue has both a glabrous surface and a normalized CD wet tensile of at least about 75 g/3 inches, preferably 105 g/3 inches, as measured by the Finch Cup Test ("FCT") at a basis weight of about 18–19 lbs/3000 sq ft ream, the tissue will not typically pill or shred when an attempt is made to use it premoistened.

We have found that once the absolute (not-normalized) CD wet tensile of each sheet drops to about 36 g/3 inches or less, the sheet does not usually have sufficient integrity to survive normal use when wet even though the sheet may not pill if handled gingerly enough to avoid tearing the sheet. Throughout this application, where a normalized wet tensile strength is mentioned, it should be understood that the tensile strength is as determined using the Finch Cup procedure in which a 3 inch sample of converted ready-to-use product having a basis weight of 18.5 lb/3000 sq ft ream, (single ply or multi-ply as the case may be) is clamped in a special fixture termed a Finch Cup. The sample is then immersed in standard tap water and tensile tested at the indicated time after immersion. For initial wet tensile strength, the measurement is conducted 5 seconds after immersing in water. We prefer use of this procedure as we have found that the results obtained using the FCT are reasonably reproducible.

Since the critical factor with regard to pill formation seems to be the degree and strength of the internal bonds between the fibers in the sheet, for basis weights other than 18.5 lb/3000 sq. ft. ream, the critical cross direction (CD) tensile strength values (75 g/3 inches or 105 g/3 inches and so forth, as the case may be) should be adjusted proportionally to the basis weight i.e., normalized. For example, a 9.25 lb/3000 sq. ft. ream sheet having a CD wet tensile of about 52.5 g/3 inches will perform satisfactorily as the CD wet tensile is proportionally the same as an 18.5 lb/3000 sq. ft. ream sheet having a CD wet tensile of 105 g/3 inches and, accordingly, the normalized CD wet tensile of this 9.25 lbs/3000 sq ft ream would be 105 9/3 inches. This conforms well with our experience in which single plies of 9.25 lbs/3000 sq. ft. ream tissue have been satisfactory at CD wet tensile strengths of 66 and 44 g/3 inches, while single plies having a CD wet tensile of 36 g/3 inches fail by shearing without leaving pills.

The set strength values provided herein have been selected based upon standard tap water, however, it should be understood that water quality may affect the initial cross direction (CD) tensile wet strength values, as well as the decay rates. Furthermore, in an aqueous medium having been adjusted for pH or in a nonaqueous medium, the values and decay rates may shift. Such shifts are contemplated herein and are within the scope and spirit of the present invention.

To ensure that the tissue product will be sufficiently flushable to avoid requiring an excessive number of flushes to clear the bowl, we prefer that the wet strength of the tissues of the present invention decays rapidly, exhibiting a normalized cross direction wet tensile of less than about ½ the initial value when measured 10 minutes after immersion. To accommodate moistening prior to use, the tissue should retain at least about 15 percent of the initial wet strength value when measured 10 minutes after immersion.

Simple addition of a temporary wet strength agent often produces a paper product that does not possess sufficient softness to be acceptable as a premium bathroom tissue for normal household use. To help bring the softness of the sheet into the premium or near premium range, we have found that it is desirable to vary the jet/wire ratio to make the sheet a little squarer than we normally use in production of wet pressed tissues. For example, in production of conventional wet press tissue, we normally control the jet to wire ratio so that the ratio of machine direction dry tensile strength to cross direction dry tensile strength of the base sheet (before converting and embossing) is about 2.5.

For tissues of the present invention, we prefer to use a jet to wire ratio producing a base sheet having a ratio of MD dry tensile to CD dry tensile of less than about 2.2, more preferably from about 1.6 to 2.1, most preferably from about 1.8 to 1.9. In some instances we may impart slightly more crepe to the web than we would normally use.

Unlike the wet strength agents disclosed in U.S. Ser. No. 08/210,836 filed on Mar. 18, 1994, and U.S. Ser. No. 08/401,690 filed on Mar. 10, 1995, both incorporated herein by reference, the wet strength agents generally do not carry a positive charge and, therefore, cannot be added to the furnish. The wet strength agent can be supplemented by adding a starch to the furnish. To further tailor the properties of the tissue and towel for a particular application cationic softeners/debonders may be added to the furnish or can be added to the web at the same places the wet strength agent is added as shown in FIGS. 2 and 16, at addition points 51, 52, 53, 57, 58, 59, 60, 61, 62, 63, 64 and 65. In some instances, we use the cationic softener/debonder with a temporary wet strength agent. In these circumstances, this mixture can also function as a temporary wet strength agent.

SUMMARY OF THE INVENTION

The present invention provides a bathroom tissue which has sufficient integrity and strength, particularly wet strength, that the tissue may be used either dry or premoistened, as well as being usable for cleaning when the region to be cleaned is thoroughly wet. Thus, a user is provided with a bathroom tissue for use wet, premoistened or dry. In addition, such a tissue according to the present invention is preferably reasonably soft, at least approaching the softness of premium quality bathroom tissue. Necessarily, the tissue must be both flushable and degradable for compatibility with use in septic systems.

The preferred bathroom tissues of the present invention combine the following five attributes:

(i) sufficient wet strength and wet-structural-integrity to be usable or cleansing while moistened;

(ii) sufficient dispersibility to be flushable in reasonable quantities in typical household toilets;

(iii) sufficient degradability to be accommodated in septic systems;

(iv) dry strength compatible to premium bath tissue;

(v) softness comparable to or at least approaching the softness of premium bathroom tissues.

Softness is not a directly measurable, unambiguous quantity but rather is somewhat subjective. The two most important components for predicting perceived softness are generally considered to be surface texture and tensile modulus sometimes referred to by others as: stiffness, stiffness modulus, or tensile stiffness. See J. D. Bates "Softness Index: Fact or Mirage?," *TAPPI*, Vol. 48, No. 4, April, 1965, pp 63A–64A. See also H. Hollmark, "Evaluation of Tissue Paper Softness", *TAPPI*, Vol. 66, No. 2, February, 1983, pp 97–99, relating tensile stiffness and surface profile to perceived softness. Alternatively, surface texture can be evaluated by measuring geometric-mean-deviation ("GM MMD") in the coefficient of friction using a Kawabata KES-SE Friction Tester.

The paper product of the present invention has a pleasing texture as indicated by the GM MMD of less than about 0.26 measured as described below and a tensile modulus of less than about 32 g/% strain, preferably less than 28 g/% strain, as determined by the procedure for measuring tensile strength as described herein except that the modulus recorded is the geometric mean of the slopes on the cross direction and machine direction load-strain curves from a load of 0 to 50 g/1 inch when a sample width of 1 inch is used. All tensile moduli referred to herein should be understood to be measured at a tensile load of 50 g/inch and reported in g/% strain, % strain being dimensionless.

In those cases in which tensile modulus is allowed to range as high as 32 g/% strain, GM MMD should be less than 0.23. In those cases in which tensile modulus is confined to the range under 28 g/% strain, GM MMD can be allowed to be as high as 0.26. In the more preferred embodiments, GM MMD should be less than 0.2 and tensile modulus less than 27 g/% strain, with GM MMD still more preferably less than 0.185 and tensile modulus less than 26 g/% strain.

It has been found that, so long as care is taken to provide a glabrous surface, tissues providing an acceptable balance among all five of the properties listed above may be formed. The tissue of the present invention is formed in the usual fashion but using a combination of commercially available temporary wet strength agents preferably water soluble aliphatic dialdehydes or commercially available water soluble organic polymers comprising aldehydic units, and optionally, cationic strength enhancing agents, such as starch. To further control the properties of the tissue, a cationic nitrogenous softener/debonder may be added to the furnish or to the web before or after the pressing roll (16) in FIG. 1. The cationic softener/debonder is chosen from the group consisting of trivalent and tetravalent cationic organic nitrogen compounds incorporating long fatty acid chains, including imidazolines, amido amine salts, linear amine amides, tetravalent or quaternary ammonium salts and mixtures thereof. In the event the strength enhancing agent is cationic starch containing aldehyde moieties it may be mixed with the furnish. Representative starches used in our process include Co-bond (R)1000 and Redibond (R)5320. However, aldehydes and aldehyde moieties containing polyols and cyclic ureas which do not have a charge are added directly on the air side of the web, directly on the Yankee or on the tissue after it is creped. The softener, if used, can be supplied to the furnish or directly onto the web. It is preferred to supply the softener on the web, preferably the air side of the web to avoid chemical contamination of the paper making process.

A tissue of the present invention (i) has sufficient wet strength and resistance to wet abrasion that it can be used premoistened; (ii) is flushable; (iii) is dispersible and biodegradable; (iv) has dry strength comparable to premium bathroom tissue; and (v) has softness comparable to modern premium bathroom tissue.

Numerous aliphatic and polymeric aldehydes can suitably be utilized to obtain the tissue of the present invention, however, to reach the five parameters set forth above, the tissue of the present invention is designed to have a glabrous surface coupled with an initial normalized temporary wet strength of at least about 75 g/3 inches, preferably about 105 g/3 inches as measured using the Finch Cup method for an 18.5 lb/3000 sq ft ream. The tissue exhibits a wet-to-dry CD tensile strength ratio of at least about 18%, preferably over 20%. Temporary wet strength is provided by use of temporary wet strength chemical moieties. Simply adding a quantity of a temporary wet strength chemical moiety such as glyoxal in the paper making process does not guarantee that the product will be well suited for use premoistened. The present inventors have found that when the tissue has both a glabrous surface and a normalized CD wet tensile of at least about 75 g/3 inches, preferably 105 g/3 inches, as measured by the FCT at a basis weight of about 18–19 lbs/3000 sq ft ream, the tissue will not typically pill or shred when an attempt is made to use it premoistened.

We have found that once the absolute (not-normalized) CD wet tensile of each sheet drops to about 36 g/3 inches or less, the sheet does not usually have sufficient integrity to survive normal use when wet even though the sheet may not pill if handled gingerly enough to avoid tearing the sheet. Suitable wet strength chargeless aliphatic and aromatic aldehydes include glyoxal, malonic dialdehyde, succinic dialdehyde, glutaraldehyde, polymeric reaction products of monomers or polymers having aldehyde groups and optionally nitrogen groups.

We have found that condensates prepared from dialdehydes such as glyoxal, or cyclic urea and polyol both containing aldehyde moieties are useful temporary wet strength agents when used independently or in combination with a conventional starch. Since these compounds do not have a charge they are added to the web before or after the pressing roll (16) or charged directly on the Yankee surface. Suitably these temporary wet strength agents are sprayed on the air side of the web prior to drying on the Yankee or on the web after creping.

The cyclic ureas have the following general formulas:

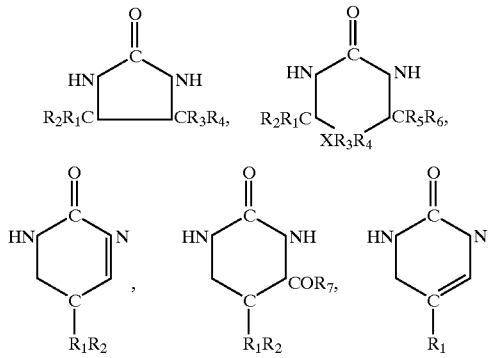

wherein $R_1$, $R_2$, $R_3$, $R_4$, $R_5$, and $R_6$ may be the same or different and each may be H, OH, COOH, R, OR, or COOR wherein R is an alkyl or a substituted alkyl group having 1 to 4 carbon atoms; $R_7$ may be H or a polyol moiety such as $C_2H_4OH$, $CH_2CH_2O(C_2H_4O)_bH$ where b is 0 to 10, $CH_2CH(OH)CH_2OH$, $[CH_2CH(CH_3)O]_cH$ where c is 1 to 10, and the like; and X may be C, O, or N; when X is O, $R_3$ and $R_4$ are not present; when X is N, $R_3$ or $R_4$ is not present.

These cyclic ureas were used in combination with aldehydes which function as temporary wet strength agents.

The preparation of these cyclic ureas is disclosed in U.S. Pat. No. 4,625,029 herein incorporated by reference in its entirety. Other U.S. Patents of interest disclosing reaction products of dialdehydes with polyols include U.S. Pat. Nos. 4,656,296; 4,547,580 and 4,537,634 and are also incorporated into this application by reference in their entirety. The dialdehyde moieties expressed in the polyols render the whole polyol useful as a temporary wet strength agent either independently or in combination with starch. In our process, conventional starch is employed when unrefined furnish is utilized. It is preferred to use unrefined furnish but if refined furnish is utilized in most instances the use of conventional starch may not be necessary. Suitable polyols are reaction products of dialdehydes such as glyoxal with polyols having at least a third hydroxyl group. Glycerin, sorbitol, dextrose, glycerin monoacrylate and glycerin monomaleic acid ester are representative polyols useful as temporary wet strength agents.

Polysaccharide aldehyde derivatives are suitable for use in the manufacture of our tissues. The polysaccharide aldehydes are disclosed in U.S. Pat. Nos. 4,983,748 and 4,675,394. These patents are incorporated by reference into this application. Suitable polysaccharide aldehydes have the following structure:

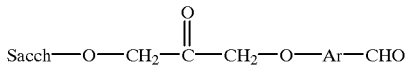

wherein Ar is an aryl group. This cationic starch is a representative cationic moiety suitable for use in the manufacture of the tissue of the present invention and can be charged with the furnish while the uncharged dialdehydes, uncharged aldehyde containing polyols and/or cyclic ureas can be added to the web before or after the pressing roll (16) as shown in FIG. 2 at positions 51, 52 and 53.

Preferably, the starch is supplied to a location, such as the suction side of the machine chest pump, in which it can react with the fiber before coming into contact with the cationic softener/debonder while the cationic softener/debonder, if supplied to an isolated location such as the stuff-box downleg, can therefore remain separated from the starch until the starch has had time to react. If the two are allowed to contact one another prior to or simultaneously with, contact of the fiber; the effectiveness of each in certain circumstances may be diminished.

We have found that condensates prepared from dialdehydes such as glyoxal or aldehyde moiety containing, cyclic ureas and polyols, are useful temporary wet strength agents when used independently or in combination with a conventional cationic starch or a cationic softener/debonder.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of are given by way of illustration only, and thus are not limiting of the present invention.

DETAILED DESCRIPTION OF THE PREFERRED EMBODIMENTS

Figure 1:
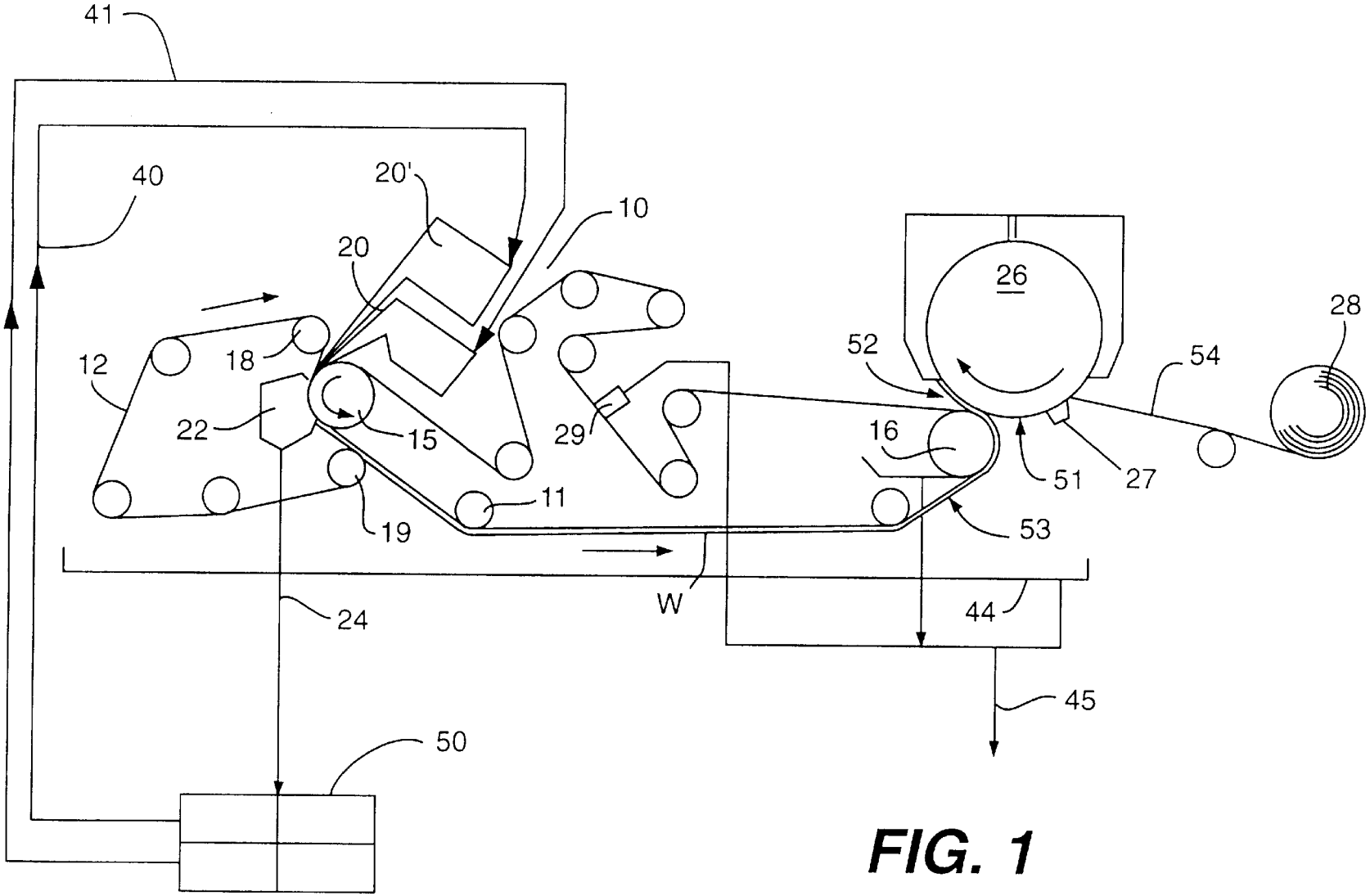
FIG. 1 is a schematic flow diagram of the papermaking process showing suitable points of addition of chargeless temporary wet strength chemical moieties, and optionally starch and softener/debonder.

The paper products of the present invention, e.g., tissue and towel may be manufactured on any papermaking machine of conventional forming configurations such as fourdrinier, twin-wire, suction breast roll or crescent forming configurations. FIG. 1 illustrates an embodiment of the present invention wherein machine chests (55) and (56) are used for preparing furnishes. The furnishes may be treated with chemicals having different functionality depending on the character of the various fibers, particularly fiber length and coarseness. The furnishes are transported through conduits (40) and (41) where the furnishes are delivered to the headbox of a crescent forming machine (10). FIG. 1 includes a web-forming end or wet end with a liquid permeable foraminous support member (11) which may be of any conventional configuration. Foraminous support member (11) may be constructed of any of several known materials including photo polymer fabric, felt, fabric or a synthetic filament woven mesh base with a very fine synthetic fiber batt attached to the mesh base. The foraminous support member (11) is supported in a conventional manner on rolls, including forming roll (15) and couch roll or pressing roll (16).

Forming fabric, i.e, pressing wire (12) is supported on rolls (18) and (19) which are positioned relative to the forming roll (15) for dewatering the web in conjunction with convergence on the foraminous support member (11) at the cylindrical forming roll (15) at an acute angle relative to the foraminous support member (11). The foraminous support member (11) and the forming wire (12) move in the same direction and at the same speed which is the same direction of rotation of the forming roll (15). The forming wire (12) and the foraminous support member (11) converge at an upper surface of the forming roll (15) to form a wedge-shaped space or nip into which two jets of water or foamed-liquid fiber dispersion is formed between the forming wire (12) and the foraminous support member (11) to force fluid through the forming wire (12) into a saveall (22) where it is collected for reuse in the process.

A wet nascent web (W) formed in the process is carried by the foraminous support member (11) to the pressing roll (16) where the wet nascent web (W) is transferred to the drum of a Yankee dryer (26). Fluid is pressed from the wet web (W) by pressing roll (16) as the web is transferred to the drum of the Yankee dryer (26) where it is dried and creped by means of a creping blade (27). The finished web is collected on a take-up roll (28).

A pit (44) is provided for collecting water squeezed from the nascent web (W) by the pressing roll (16) and the Uhle box (29). The water collected in the pit (44) may be collected into a flow line (45) for separate processing to remove fibers from the water and to permit recycling of the water back to the papermaking machine (10). The liquid is collected from the furnish in the saveall (22) and is returned through line (24) by a recycle process generally to machine chest (50).

Dewatering of the wet web is provided prior to the thermal drying operation, typically by employing a nonthermal dewatering means. The nonthermal dewatering step is usually accomplished by various means for imparting mechanical compaction to the web, such as vacuum boxes, slot boxes, coacting press rolls, or combinations thereof. For purposes of illustrating the method of the present invention, the wet web may be dewatered by subjecting it to a series of vacuum boxes and/or slot boxes. Thereafter, the web may be further dewatered by subjecting it to the compressive forces exerted by nonthermal dewatering means, for example, a forming roll (15), followed by a pressing roll (16) coacting with a thermal drying means (26). The wet web can be carried by the foraminous conveying means (11), through the nonthermal dewatering means (12), and continuing to the pressing roll (16) where in the web was dewatered to a fiber consistency of at least about 5% up to about 50%, preferably at least 15% up to about 45%, and more preferably to a fiber consistency of approximately 40%.

The dewatered web is applied to the surface of thermal drying means, preferably a thermal drying cylinder such as a Yankee drying cylinder (26). Under the definition of "Yankee" is included all large cast-iron drying cylinders some of which may be ceramic coated on which towel, tissue, wadding, and machine-glazed papers are among the grades produced. Diameters typically range from 10–20 feet and widths can approach 300 inches. A typical diameter for a Yankee drying drum (26) is 12 feet. Speeds in excess of 6000 ft/min. at weights greater than 380,000 pounds are not uncommon. Dryers typically incorporate a center shaft and are supported on journals by two large antifriction bearings. Steam, up to 160 psig (code limitation for cast-iron unfired pressure vessels) is supplied through the front-side journal and exhausted, along with condensate, through the back-side journal. A typical steam pressure is 125 psig. At least one pressing roll (16), typically loaded between 200 and 500 pounds/linear inch, is employed to press the web uniformly against the shell face. The web or sheet is removed from the dryer several quadrants away, having been imparted with properties characteristic of the desired paper product.

Adhesion of the dewatered web to the cylinder surface is facilitated by the mechanical compressive action exerted thereon, generally using one or more pressing rolls (16) that form a nip in combination with thermal drying means (26). This brings the web into more uniform contact with the thermal drying surface.

The paper products of the present invention may be made by conventional paper making process such as those described in U.S. Pat. Nos. 3,879,257; 3,903,342; 4,000,237; 3,301,746; 4,440,597; 4,894,118; 4,883,564; 3,821,068; and 3,903,342, each of which is incorporated herein by reference in its entirety.

Figure 2:
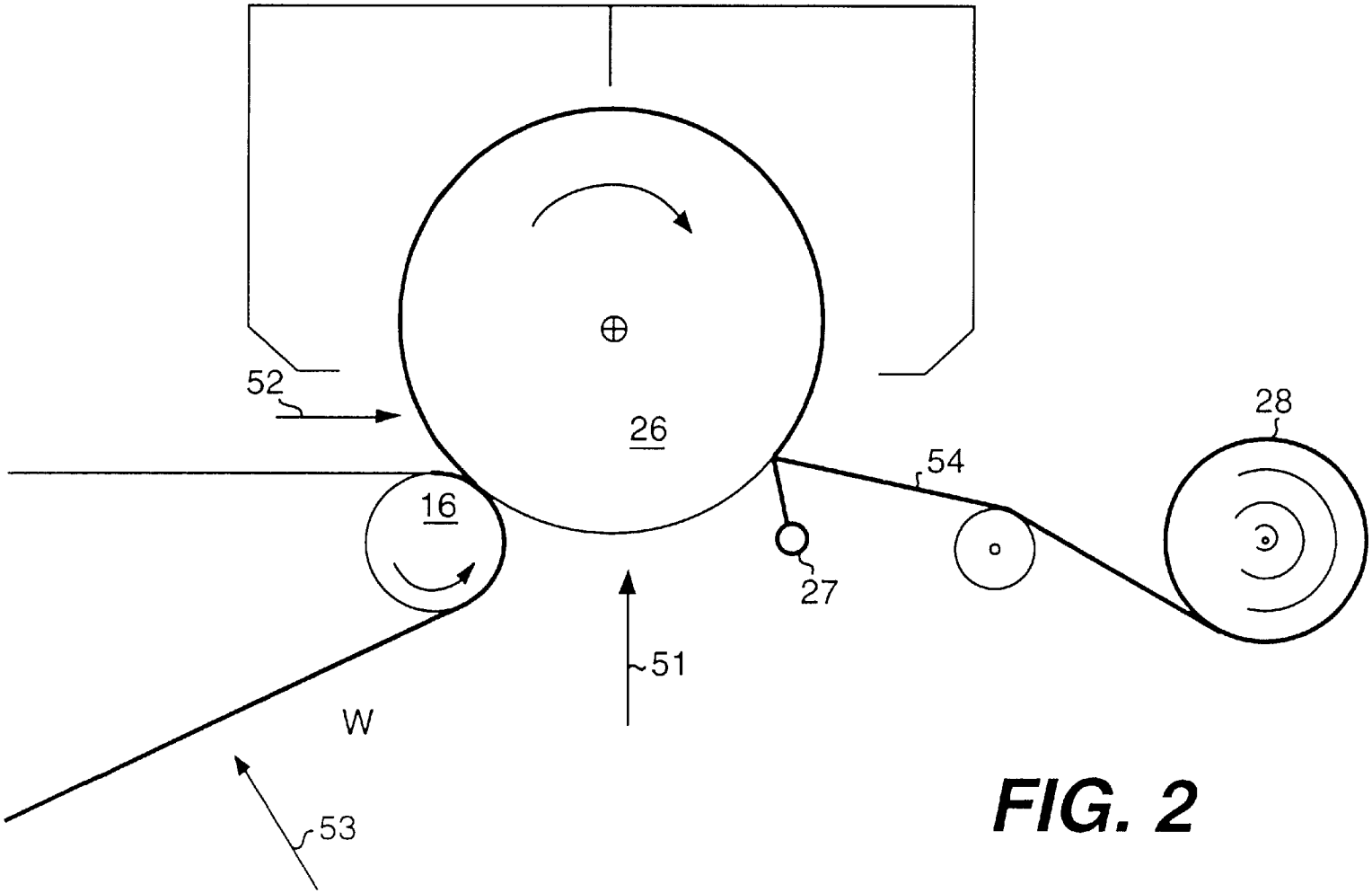
FIG. 2 is a drawing showing the optimum positions from which uncharged dialdehydes or polyols are added to the web.

FIG. 2 illustrates the drying and creping of the cellulosic web to produce tissue and towel. Both one ply and multi-ply towel and tissue can be produced by the process according to the present invention. According to one embodiment of the process of the invention, the temporary wet strength agent can be applied directly on the Yankee (26) at position (51) prior to application of the web thereto. In another preferred embodiment, the wet strength agent can be applied from position (52) and (53) on the air-side of the web or on the Yankee side of the web. In the event it is desired to use softeners, these are suitably sprayed on the air side of the web from position (52) or (53) as shown in FIG. 2. The softener/debonder can also be added to the furnish. Again, when starch is added to the furnish the softener should be added after the starch has been added to achieve maximum effectiveness.

Unfortunately, simply adding a quantity of temporary wet strength aldehydic monomer or polymer to conventional furnishes for tissue or to the web or Yankee (26) as shown in FIG. 2 neither guarantees that the product will be well suited for use premoistened nor does it guarantee that the product will possess sufficient softness to be acceptable as a premium bathroom tissue for normal household use.

Unless the tissue has both a glabrous surface and an initial normalized CD wet tensile of at least about 75 g/3 inches, preferably 105 g/3 inches, most preferably 135 g/3 inches, as measured by the Finch Cup Test (FCT), the tissue will typically pill or shred when an attempt is made to use it premoistened. Both to avoid more serious plumbing problems and to ensure that the tissue product will be sufficiently flushable to avoid requiring an excessive number of flushes to clear the bowl, the tissues of the present invention preferably exhibits a normalized cross direction wet tensile decreasing to less than about 60 g/3 inch strip, more preferably less than about 45 g/3 inch strip.

Even if enough wet strength resin is added to bring the initial normalized CD wet tensile above 75 g/3 inches, simple addition of a temporary wet strength agent does not guarantee that the tissue will not shred or pill if used premoistened. Typically, products made on through air drying equipment will not have a glabrous surface but rather will have the appearance of the brand Ch tissues illustrated in FIG. 4 which can be termed "crinose" or "non-glabrous". As demonstrated hereinafter, tissues having a crinose surface can have a normalized CD wet tensile well above 75 g/3 inches and still pill or shred if an attempt is made to use them premoistened.

We have found that in most cases, tissues having significant wet strength (above about 75 g/3 inches normalized CD wet tensile) produced using conventional wet pressing technology will exhibit a very smooth glabrous surface as compared to tissues made on through air drying equipment, particularly if the tissue is calendered or if it has been dewatered by a high level of uniform overall compaction or pressing such as occurs between two felts or as the web passes through a nip, particularly a nip including a suction pressure roll. For purposes of this invention, where there is doubt whether the surface of a tissue is glabrous, as only a few small fibrils project from the surface, if that tissue (i) has a normalized FCT wet strength above 75 g/3 inches as described below, and (ii) will survive four wet rubs across moist pigskin without leaving pills on the pigskin, the surface should be considered glabrous.

Tissues and towel of the present invention may be manufactured in either multi-ply or single-ply formats. Normally, it is considered easiest to manufacture premium quality wet pressed tissues in the two ply format in which two light weight plies are embossed together with the softer side of each ply facing outwardly but single ply products having the specified properties should be considered within the scope of the present invention. Our process is particularly suitable for the manufacture of single ply towels having superior wet strength properties. The wet strength agents carrying no charge are preferably applied by spraying onto the web prior to the pressing roll (16) or after the pressing roll (16) or on the Yankee (26). However, strength enhancing agents such as cationic starches and cationic softeners/debonders may be utilized.

According to one embodiment of the present invention, in the manufacture of tissue preferably about 3 to 40 pounds of the uncharged wet strength agent is sprayed for each ton of fiber in the furnish; the more preferred range for tissue manufacture is 3 to 35 pounds of the wet strength agent for each ton of fiber in the furnish; and the most preferred range is 5 to 30 pounds of the wet strength agent for each ton of fiber in the furnish. In the manufacture of towel the range is about 10 to 50 pounds of the wet strength agent for each ton of fiber in the furnish; the more preferred range of the wet strength agent is about 10 to 45 for each ton of fiber in the furnish; and the most preferred range is 10 to 40 pounds of the wet strength agent for each ton of fiber in the furnish.

In conjunction with the uncharged chemical moiety cationic starch may suitably be added to produce products having excellent wet strength properties. The amount of starch added is preferably about 1 to 15 pounds for each ton of fiber in the furnish; the more preferred range is about 1 to 12 pounds for each ton of fiber in the furnish; and the most preferred range is about 2 to 10 pounds of starch for each ton of fiber in the furnish. When manufacturing towel the amount of starch added is preferably between about 1 and 15 pounds for each ton of fiber in the furnish; the more preferred range is about 2 to 20 pounds; and the most preferred range is about 2 to 15 pounds of starch for each ton of fiber in the furnish.

Softeners are used in the manufacture of tissue and towel having high wet strength to either soften the high friction obtained when adding strength enhancing agents such as starch or to use them as wet strength enhancing agents in combination with the uncharged aldehyde containing chemical moieties. In the manufacture of tissue a preferred range is about 1 to 10 pounds for each ton of fiber in the furnish; the more preferred range is about 1 to 7 pounds of the softener for each ton of the fiber in the furnish; and the most preferred range is about 2 to 5 pounds of the softener for each ton of fiber in the furnish. When manufacturing towels having excellent wet strength properties the preferred range for the addition of the softener is about 1 to 15 pounds for each ton of fiber in the furnish; the preferred range is about 1 to 12 pounds; and the most preferred range is about 2 to 10 pounds of the softener for each pound of fiber in the furnish.

In one process according to the present invention, the weight ratio of the uncharged aldehyde containing chemical moiety to the strength enhancing agent, such as starch is preferably about 1:1 to about 8:1; more preferably about 1:1 to about 7:1; and most preferably about 1:1 to about 6:1.

In one process according to the present invention, the weight ratio of the uncharged aldehyde containing chemical moiety to the softener/debonder is preferably about 2:1 to about 8:1; more preferably about 3:1 to about 7:1; and most preferably 3:1 to about 6:1. When, along with the aldehyde containing uncharged chemical moiety strength enhancing agent other components, such as starch and softener/debonder are used preferred total amounts of all three components is in the range of about 5 to 65 pounds for each ton of fiber in the furnish when tissue is manufactured and about 12 to 90 pounds for each ton of fiber in the furnish when towel is manufactured. The more preferred range for tissue is about 5 to 50 pounds of the three additives for each ton of fiber in the furnish; the more preferred range for towels is about 13 to 75 pounds of the three additives for each ton of fiber in the furnish; and the most preferred range for tissue is about 9 to 45 pounds of the three additives for each ton of fiber in the furnish and for towel the most preferred range is about 14 to 65 pounds of the three additives for each ton of fiber in the furnish.

The preferred ratio of the aldehyde containing uncharged chemical moiety to the strength enhancing agent and softener/debonder useful in the manufacture of tissue is about 8:1:1 to about 2:2:1. The more preferred ratio is about 3:1:1: to about 35:12:7, and the most preferred ratio is about 5:2:2 to about 6:2:1 for towel the preferred range is about 10:1:1 to about 10:5:3, the more preferred range is about 10:2:1 to about 45:20:12, the most preferred range is about 5:1:1 to about 8:3:2.

A quantity of a nitrogenous cationic softener/debonder is optionally sprayed as shown in FIG. 2 preferably from position (53) or suitably from position (52). It is also useful in special circumstances to add the softener/debonders with the furnish. QUASOFT® 202-JR made by Quaker Chemical Corporation is the preferred nitrogenous cationic softener/debonder. This softener/debonder may be used together with the strength enhancing agents such as starches, aldehydic starches or cationic aldehydic starches such as Co-Bond (R)1000 disclosed in the hereinbefore cited companion U.S. patent applications Ser. No. 08/210,836 filed on Mar. 18, 1994 and U.S. Ser. No. 08/401,690 filed on Mar. 10, 1995.

In our process we utilize the chargeless aldehydes, and chargeless aldehydes containing polyols, polymers and cyclic ureas or a mixture of these as wet strength agents. These are added before or after the pressing roll (16) on the Yankee (26) or after creping. Optionally, when starch is added with the furnish, cationic softeners/debonders are also added to the furnish or sprayed on the web before or after the pressing roll (16). The softener is usually sprayed on the air side of the web. QUASOFT® 202-JR is a mixture of two major classes of cationic compounds derived from oleic acid and diethylenetriamine (DETA).

Linear Aminoamides

I) di-amide

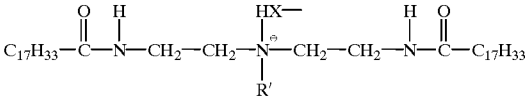

Imidazolines (Cyclic Amineamids)

II) di-amide derived

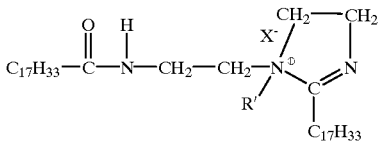

The nitrogenous cationic softener/debonder is hypothesized to ionically attach to cellulose, reducing the number of sites available for hydrogen bonding thereby decreasing the extent of fiber-to-fiber bonding decreasing the dry strength more than the wet.

The present invention may be used with a particular class of softener materials—amido amine salts derived from partially acid neutralized amines. Such materials are disclosed in U.S. Pat. No. 4,720,383; column 3, lines 40–41. Also relevant are the following articles: Evans, Chemistry and Industry, Jul. 5, 1969, pp. 893–903; Egan, *J. Am. Oil Chemist's Soc.*, Vol. 55 (1978), pp. 118–121; and Trivedi et al., *J. Am. Oil Chemists' Soc., June* 1981, pp. 754–756. All of the above are incorporated herein by reference. As indicated therein, softeners are often available commercially only as complex mixtures rather than as single compounds. While this discussion will focus on the predominant species, it should be understood that commercially available mixtures would generally be used in practice.

QUASOFT® 202-JR is a suitable softener material which may be derived by alkylating a condensation product of oleic acid and diethylenetriamine. Synthesis conditions using a deficiency of alkylating agent (e.g., diethyl sulfate) and only one alkylating step, followed by pH adjustment to protonate the non-ethylated species, result in a mixture consisting of cationic ethylated and cationic non-ethylated species. A minor proportion (e.g. about 10%) of the resulting amido amines cyclize to imidazoline compounds. Since only the imidazoline portions of these materials are quaternary ammonium compounds, the compositions as a whole are pH-sensitive. Therefore, in the practice of the present invention with this class of chemicals, the pH in the headbox should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 14 to 20 carbon atoms. These compounds have the advantage of being relatively insensitive to pH.

Biodegradable softeners as such can be utilized. Most biodegradable softeners are cationic but those disclosed in U.S. Pat. No. 5,354,425 and incorporated herein by reference do not carry a charge and have to be sprayed from positions 51, 52, or 53 as shown in FIG. 2.

Representative biodegradable cationic softeners/debonders are disclosed in U.S. Pat. Nos. 5,312,522; 5,415,737; 5,262,007; 5,264,082; and 5,223,096, each of which is incorporated herein my reference in its entirety. These compounds are biodegradable diesters of quarternary ammonia compounds, quaternized amine-esters, biodegradable vegetable oil based esters functional with quarternary ammonium compounds. Diester dioleyldimethyl ammonium chloride and diester dierucyldimethyl ammonium chloride are representative biodegradable softeners.

The softener employed for treatment of the web is provided at a treatment level that is sufficient to impart a perceptible degree of softness to the paper product but less than an amount that would cause significant runnability and sheet strength problems in the final commercial product. The amount of softener employed, on a 100% active basis, is preferably from about 0.5 pounds per ton of cellulose pulp up to about 10 pounds per ton of cellulose pulp, more preferably from about 1 to about 5 pounds per ton, while from about 1 to about 3 pounds per ton is most preferred. In some cases, use of the non-quaternary compounds may lead to deposits in the plumbing of the paper machine. For this reason, the quaternary compounds are usually preferred.

To help bring the softness of the sheet into the premium or near premium range, we have found that it is desirable to vary the jet/wire ratio to make the sheet a little squarer than we normally use in production of wet-pressed tissues. For example, as mentioned previously, in production of conventional wet pressed tissue, we normally control the jet to wire ratio so that the ratio of machine direction dry tensile strength to cross direction dry tensile strength of the base sheet (before converting and embossing) is about 2.5. For tissues of the present invention, we prefer to use a jet to wire ratio producing a base sheet having a ratio of MD dry tensile to CD dry tensile of about 1.6 to about 2.1, preferably from about 1.8 to about 1.9.

Similarly, we prefer to impart more crepe to the web than we would normally use. For example, in conventional tissue, we would normally impart about 18–20% crepe to the web as it is creped off of the Yankee (26). For the tissues of the present invention, we prefer to impart a crepe of at least about 22%, more preferably at least about 23–24%. Usually softener/debonder is not required when uncharged aldehydes, polyols and water soluble polymers and cyclic ureas are added to the web as shown in FIG. 2. To tailor the properties of certain paper products either cationic starch or cationic softener may be utilized. If substantial amounts of starch are added optionally, the cationic softener/debonder may also be added to keep the tensile modulus within acceptable limits.

The amount of aldehydic water soluble temporary wet strength enhancing agent/starch and softener/debonder added to the paper product is preferably regulated to obtain a ratio of cross direction wet tensile strength to cross direction dry tensile strength of over 18%. A more preferable range of the ratio is over at least about 20%, a still more preferably over about 22%, and again still more preferably about 23 to 24%. Most preferably, the ratio should be over 24%. This preferred ratio can be achieved without the addition of starches or softeners/debonders however, it can also be achieved when utilizing either the cationic starch or the cationic softener/debonder or a combination of both.

Preferred paper products of the present invention have a pleasing texture as indicated by the GM MMD of less than about 0.26 measured as described below and a tensile modulus of less than about 32 g/% strain, preferably less than about 28 g/% strain, as determined by the procedure for measuring tensile strength as described.

Figure 3A:
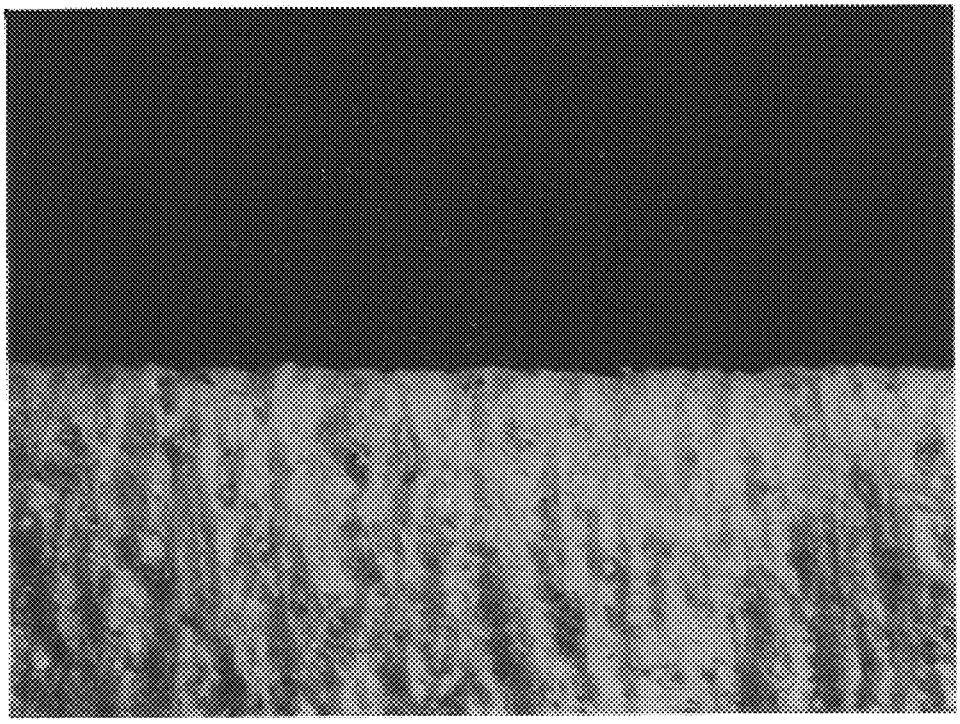
FIG. 3A is a photomicrograph taken at 20×, illustrating the glabrous nature of the surface of a tissue made according to the present invention as described in Example 8 having glyoxal as the aldehydic moiety.
Figure 3B:
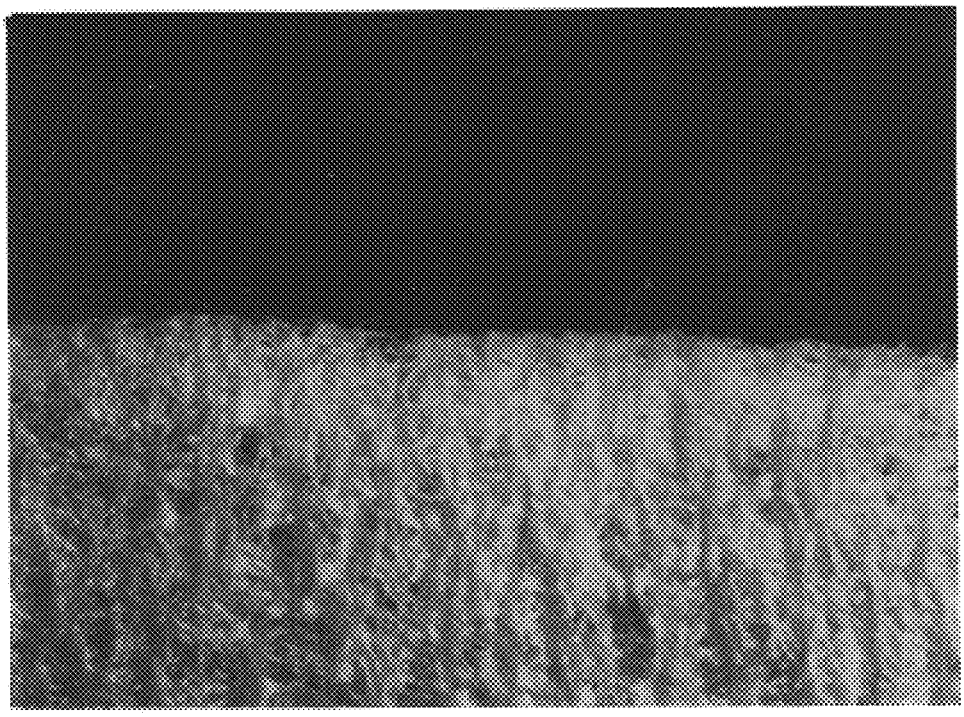
FIG. 3B is a photomicrograph taken at 20×, illustrating the glabrous nature of the surface of a tissue made according to the present invention as described in Example 9 having glyoxal and starch to enhance the wet strength of the tissue.

FIGS. 3A and 3B are photomicrographs taken at 20× of the surface of tissues made according to the present invention described in Examples 8 and 9 illustrating the glabrous nature of the surface of tissues of the present invention. FIG. 3A illustrates the surface of a tissue having glyoxal as the aldehyde moiety and FIG. 3B illustrates a tissue having both glyoxal and cationic starch applied thereto.

Tissues and towels of the present invention exhibit substantial ability to resist wet abrasion thereby enabling them to be used premoistened for effective cleansing. To evaluate the ability of a tissue or towel to resist wet abrasion and to quantify the degree of pilling when a moistened tissue or towel is wetted and rubbed, we employ the following test using a Sutherland Rub tester to reproducibility rub tissue or towel over a pigskin surface which is considered to be a fair substitute for human skin, the similarity being noted in U.S. Pat. No. 4,112,167. Four sheets of tissue or towel are severed from a roll of tissue. The sheets are stacked so that the machine direction in each sheet is parallel to that of the others. By use of a paper cutter, the sheets are cut into specimens 2 inches in width and 4.5 inches in length.

A pigskin is stretched over the rubbing surface of a Sutherland Rub tester which is described in U.S. Pat. No. 2,734,375. The pigskin is preconditioned by spraying a mist of demineralized water at neutral pH from a mist spray bottle until the pigskin is saturated. However, care should be taken to ensure that no excess water, or puddling, remains on the surface of the pigskin. A sponge is positioned in a tray and the tray is filled with ¾ inch of demineralized neutral pH water. A smooth blotter stock is positioned on the top of the sponge.

A specimen is clamped between two clamps at each end of a transparent plexiglass rub block which is adapted to be removably secured to moving arm of the Sutherland Rub tester, the clamps being positioned to hold the sheet to be tested against the rubbing surface of the rub block by wrapping the specimen around the lower portion of the block with the MD direction of the sample parallel to the direction of movement of the rubbing arm. The rub block with the specimen is placed onto the smooth surface of the blotter stock. The specimen is carefully watched through the transparent rub block until the specimen is saturated with water, at which point, the rub block with the specimen is removed from the blotter stock. At this stage, the specimen will be sagging since it expands upon wetting. The sag is removed from the specimen by opening a clamp on the rub block permitting the operator to ease the excess material into the clamp, removing the sag and allowing the sample to be thereafter reclamped so that it conforms to the lower surface of the rub block, i.e., the length of wet material matching the distance between the two clamps.

The Sutherland Rub tester is set for the desired number of strokes. The pigskin is moistened by using three mist applications of water from the spray bottle. After the water is absorbed into the pigskin and no puddles are present, the transparent rub block bearing the specimen is affixed to the arm of the Sutherland Rub tester and the specimen brought into contact with the pigskin. Upon activation, the specimen is rubbed against the pigskin for the predetermined desired number of strokes. Normally, only a few seconds, ideally less than about 10 seconds will elapse between first wetting the tissue and activation of the Sutherland Rub Tester. Thereafter, the specimen is detached from the Sutherland Rub tester and evaluated to determine the condition of the specimen, particularly whether pilling, shredding or balling of tissue on the rub block has occurred. Thereafter, the pigskin surface and the rub block are cleaned to prepare for the next specimen.

For convenience, we define a quantity which we term the "Wet Abrasion Resistance Number" or WARN as being the number of strokes that the specimen will endure on this test before pilling is observed on the pigskin. For purposes of this invention, we prefer structures having a Wet Abrasion Resistance Number of at least about 4, more preferably at least about 8. For toweling, we prefer a WARN of at least about 8, more preferably at least about 15.

Figure 4:
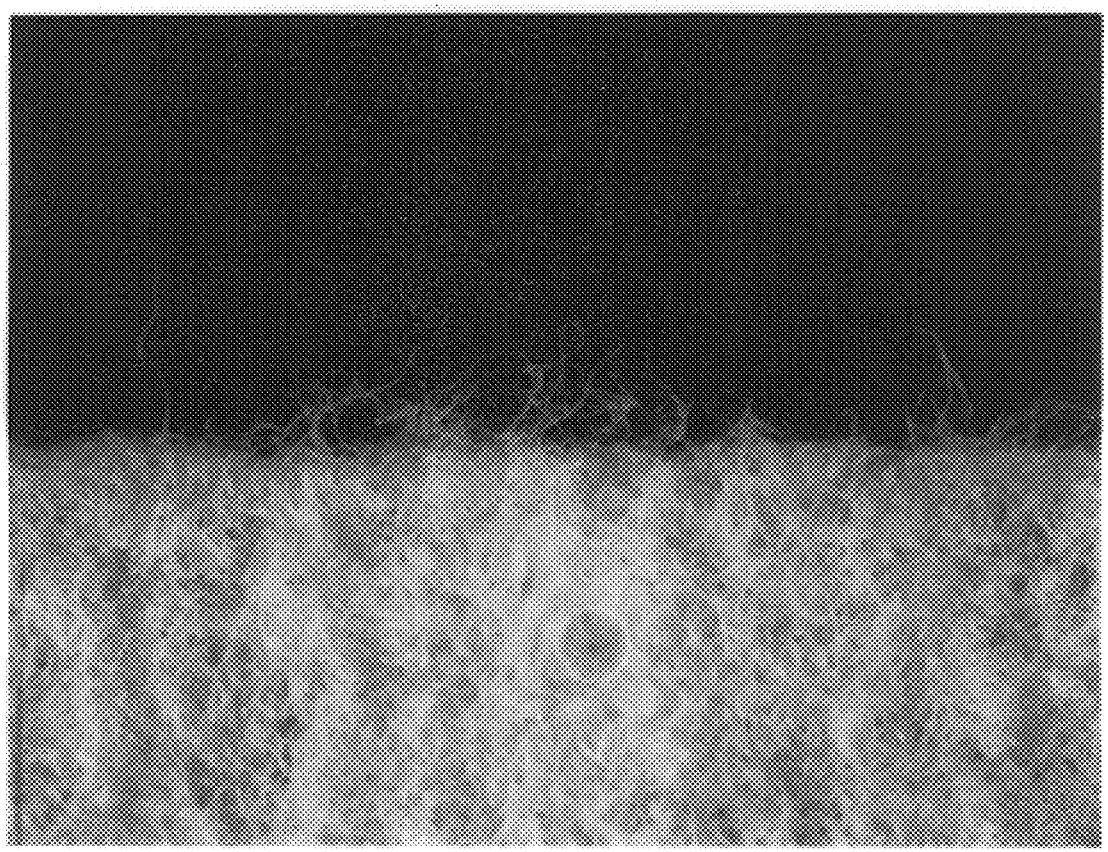
FIG. 4 is a photomicrograph taken at 20× of the surface of a competitive ("Brand Ch") tissue which possesses an initial CD wet tensile strength of 81 g/3 inches but possesses a crinose (non-glabrous) surface.

FIG. 4 is a photomicrograph at an enlargement of 20× actual size of the surface of a paper product identified as Brand Ch illustrating the crinose or non-glabrous surface of the Brand Ch paper product having many fibers projecting therefrom. Pilling occurs readily when the Brand Ch paper product is premoistened and rubbed, so that while an individual may use the paper product for cleansing the perineum and adjacent regions of the human body in a dry or even slightly moist condition passingly well, if the Brand Ch paper product is premoistened and used to cleanse these regions, the surface of the tissue tends to pill or form small balls which may be difficult to remove, at least partially defeating the intent in using the product premoistened. Often the tissue will shred if used premoistened.

Figure 5A:
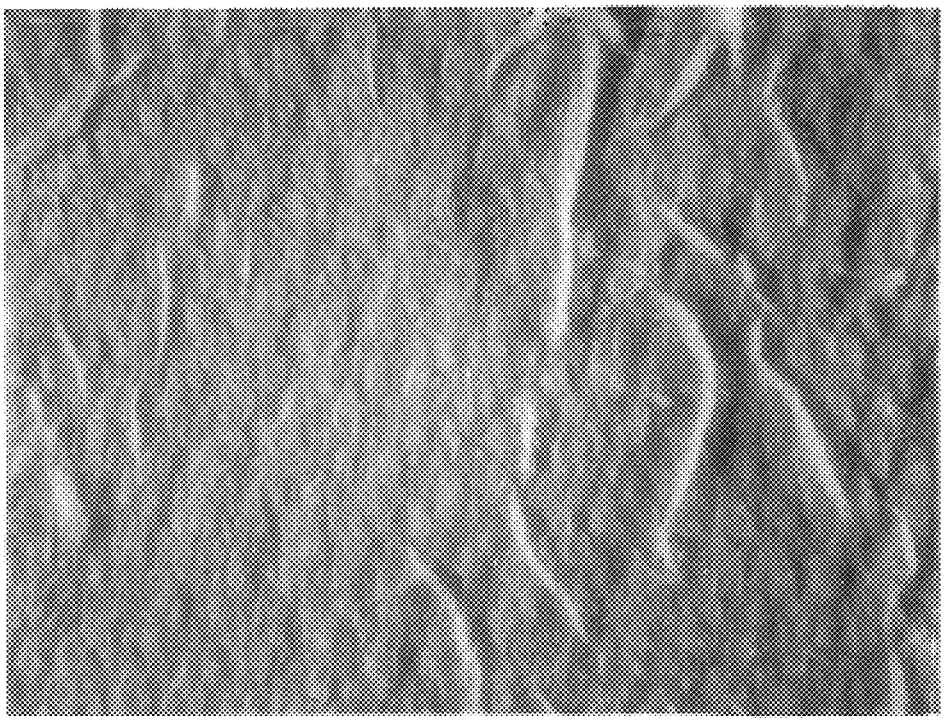
FIG. 5A is a photomicrograph of a moistened tissue sample of Brand Ch tissue illustrating the pilling occurring after three rubs over a pigskin surface.

FIG. 5A is a photomicrograph taken at a magnification of 6× of a moistened Brand Ch tissue which has been tested on the Sutherland Rub tester according to the test method described above, subjecting the moistened tissue to only three strokes over the pigskin. As is apparent from FIG. 5A, the Brand Ch tissue exhibited substantial pilling and balling of the tissue after completion of the test method. Often, when subjected to this test, the tissue of brand Ch will tear or shred before four strokes are completed.

Figure 5B:
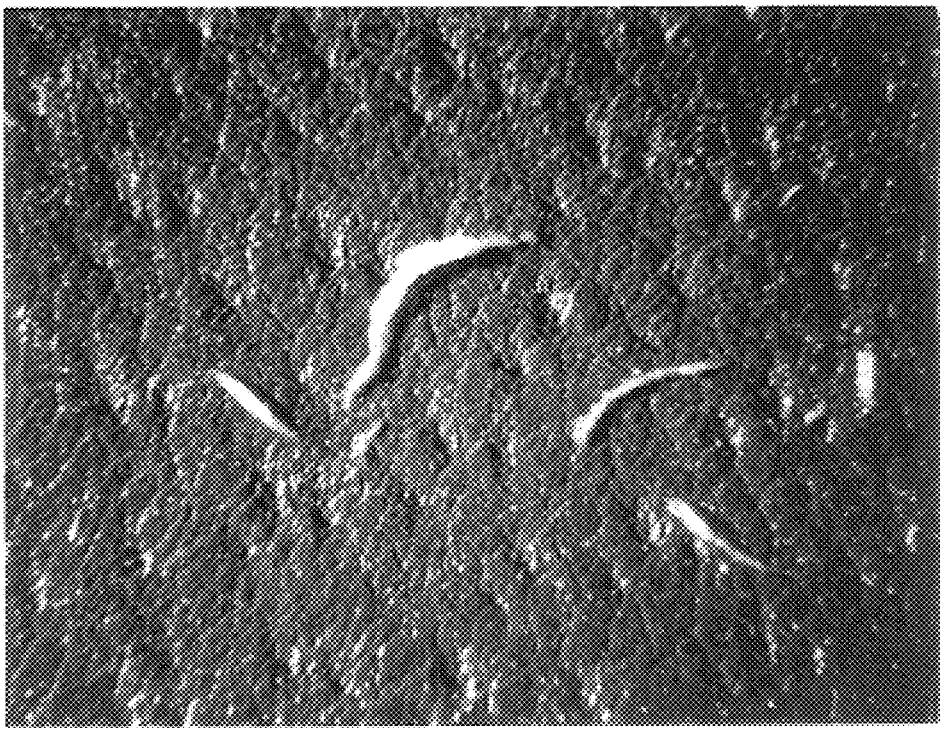
FIG. 5B is a photomicrograph of the pigskin illustrating the pills left behind after three rubs of a moistened Brand Ch tissue over the pigskin surface.

FIG. 5B is a photograph of the pigskin after the moistened Brand Ch tissue was tested on the Sutherland Rub tester for three rubs according to the test method described above. The photograph shows substantial detritus from excessive pilling and balling remaining after completion of the test.

Figure 6A:
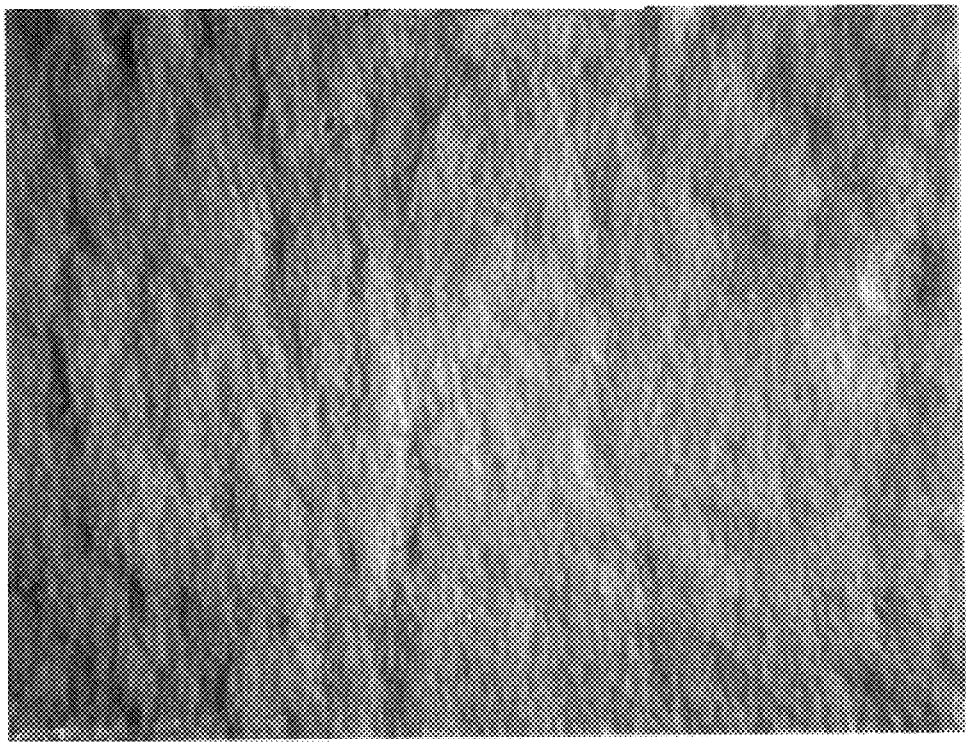
FIG. 6A is a photomicrograph of a tissue of the present invention, utilizing glyoxal as the aldehyde moiety, illustrating its ability to withstand four rubs over a pigskin surface without pilling.

FIG. 6A is a photograph of a moistened tissue of the present invention which has been tested on the Sutherland Rub tester according to the test method described above subjecting the moistened tissue to four strokes over the pigskin. After completion of the test, the tissue, according to the present invention, did not exhibit pilling, shredding or balling of the tissue.

Figure 6B:
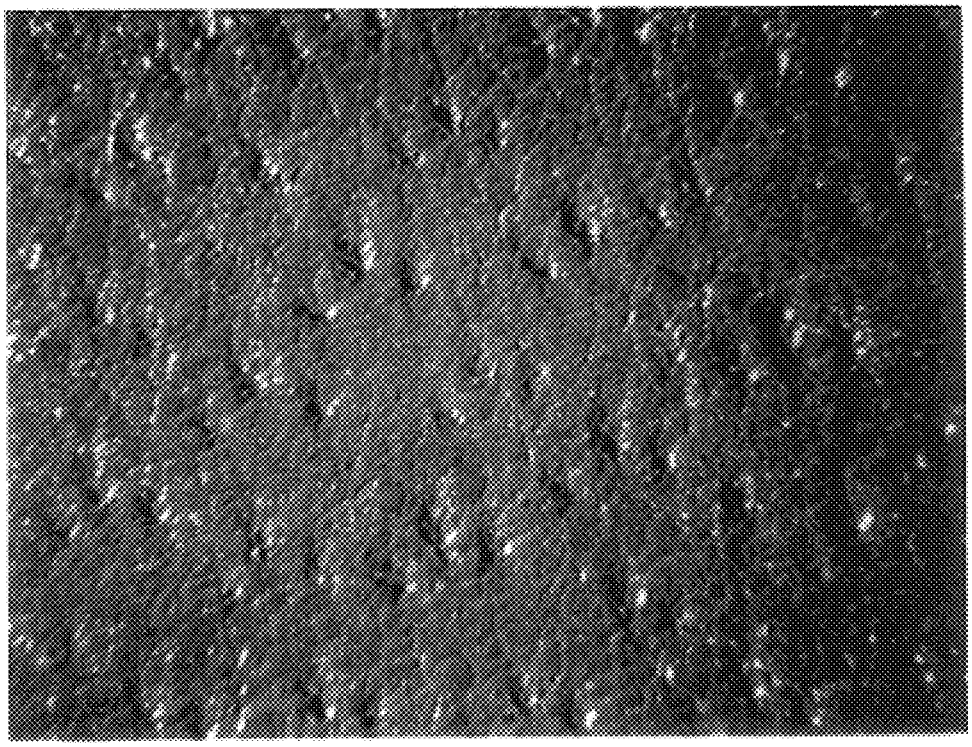
FIG. 6B is a photomicrograph of the pigskin after four rubs of a moistened tissue according to the present invention, utilizing glyoxal as the aldehyde moiety, illustrating that the pigskin surface remains clean.

FIG. 6B is a photograph of the pigskin after the moistened tissue, according to the present invention, was subjected to the test described above. As is apparent from a comparison of FIGS. 5B and 6B, even though the surface of the pigskin was littered with detritus severed from the tissue when Brand Ch tissue was tested, the pigskin remained clean after testing of the tissue of the present invention.

Figure 6C:
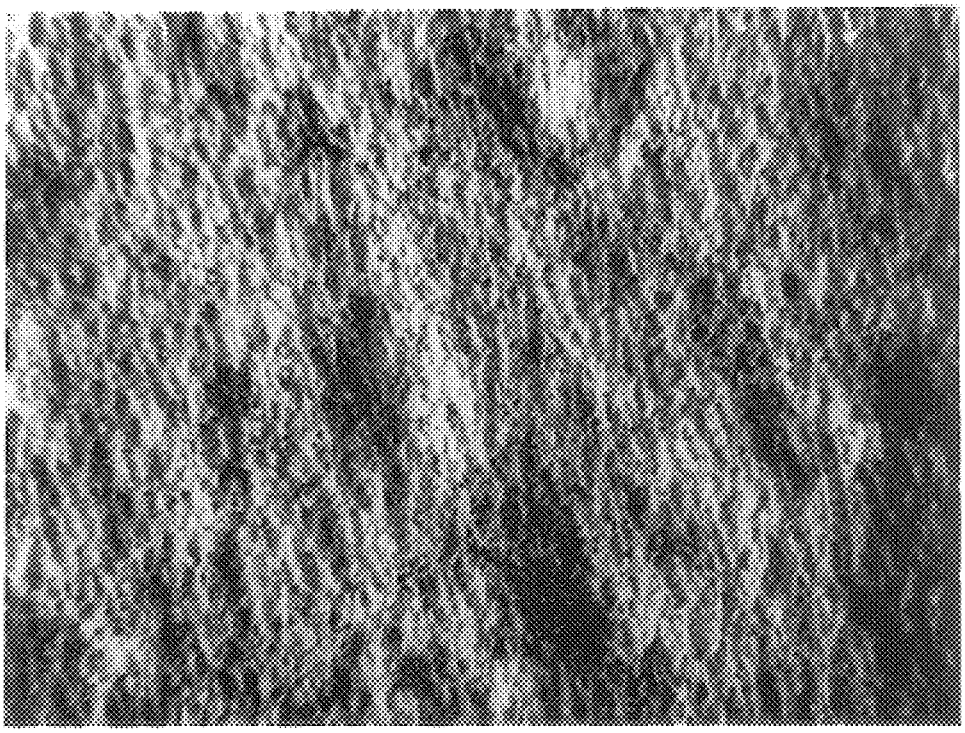
FIG. 6C is a photomicrograph of a tissue of the present invention, utilizing glyoxal and starch as the wet strength agent, illustrating its ability to withstand four rubs over a pigskin surface without pilling.
Figure 6D:
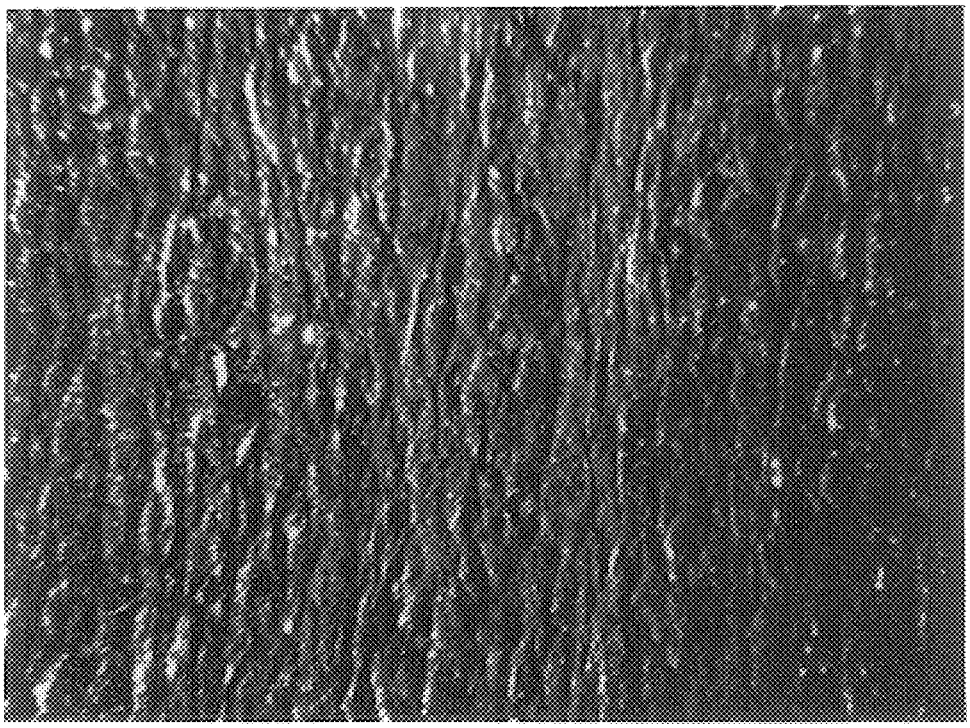
FIG. 6D is a photomicrograph of pigskin after four rubs of a moistened tissue according to the present invention, utilizing glyoxal and starch as the wet strength agent, illustrating that the pigskin surface remains clean.

FIGS. 6C and 6D are photographs of the tissue and pigskin after testing with the Sutherland Rub tester as described hereinabove; the tissue according to the present invention, utilizing both the glyoxal aldehyde and starch. After completion of the test, the tissue, according to the present invention, did not exhibit pilling, shredding or balling of the tissue.

Figure 7:
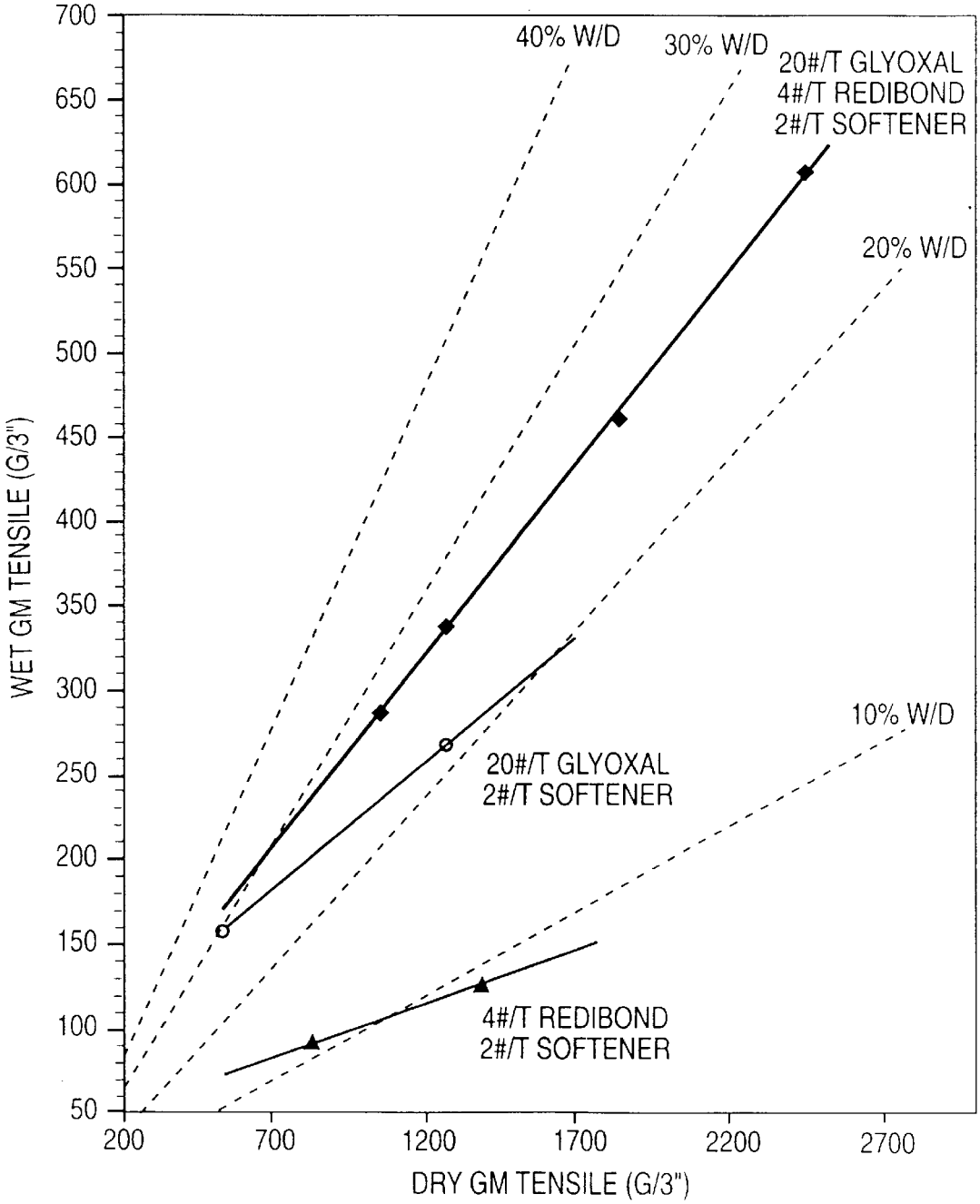
FIG. 7 is a graph showing the advantageous wet strength properties obtained when glyoxal and starch were applied on a one ply tissue.
Figure 8:
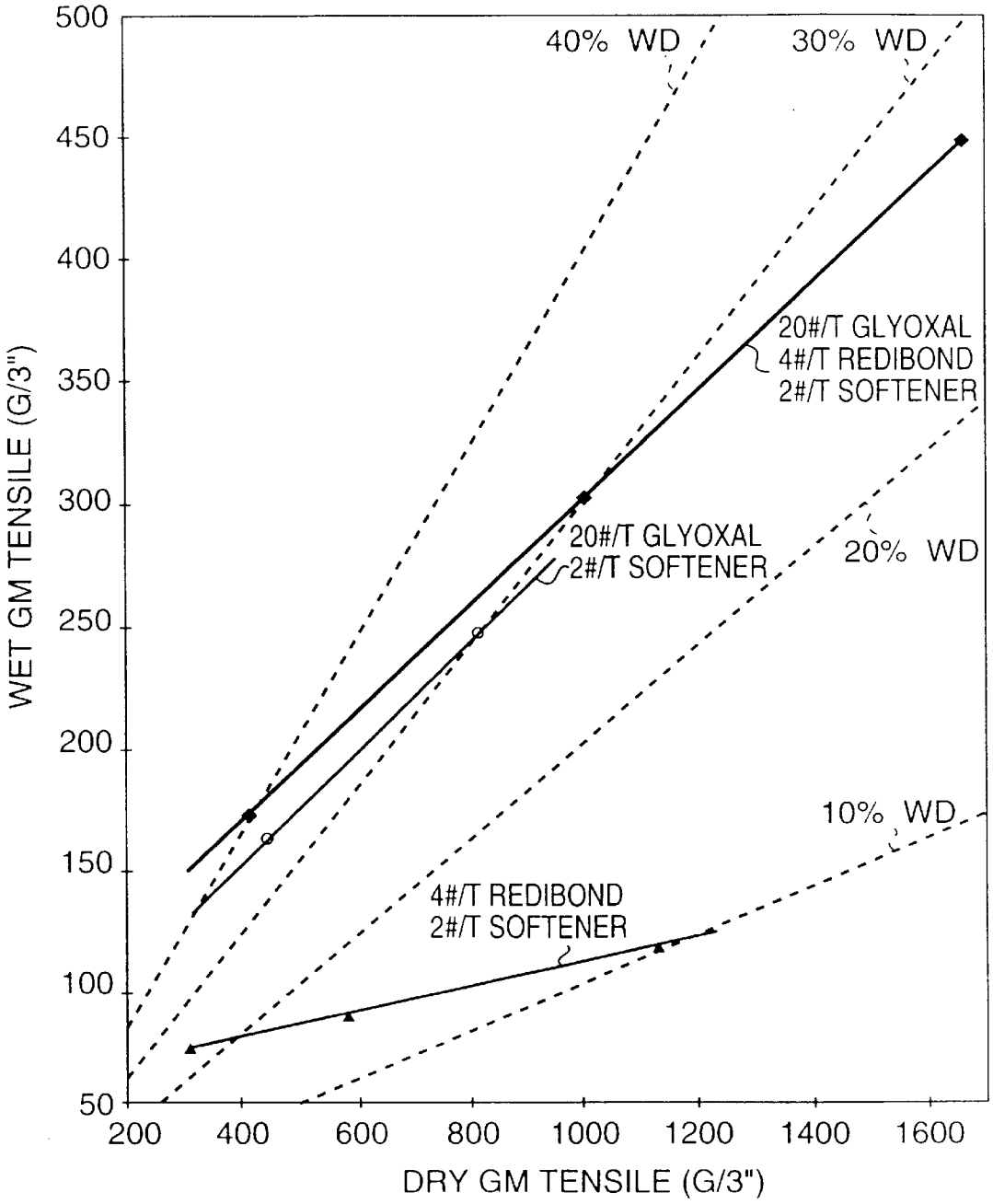
FIG. 8 is a graph showing the advantageous wet strength properties obtained when glyoxal and starch were applied on a two ply tissue.

FIGS. 7 and 8 are graphs showing the advantageous wet strength properties obtained when glyoxal and starch are applied on one and two ply tissue. The starch may comprise both amylose and amylopectin moieties. The ratio of amylose to amylopectin is about 1 to 99 to about 99 to 1. Redibond comprises about 99 to 100% amylopectin and 1 to 0% amylose standard starch comprises about 80% amylopectin and 20 percent amylose.

Figure 9:
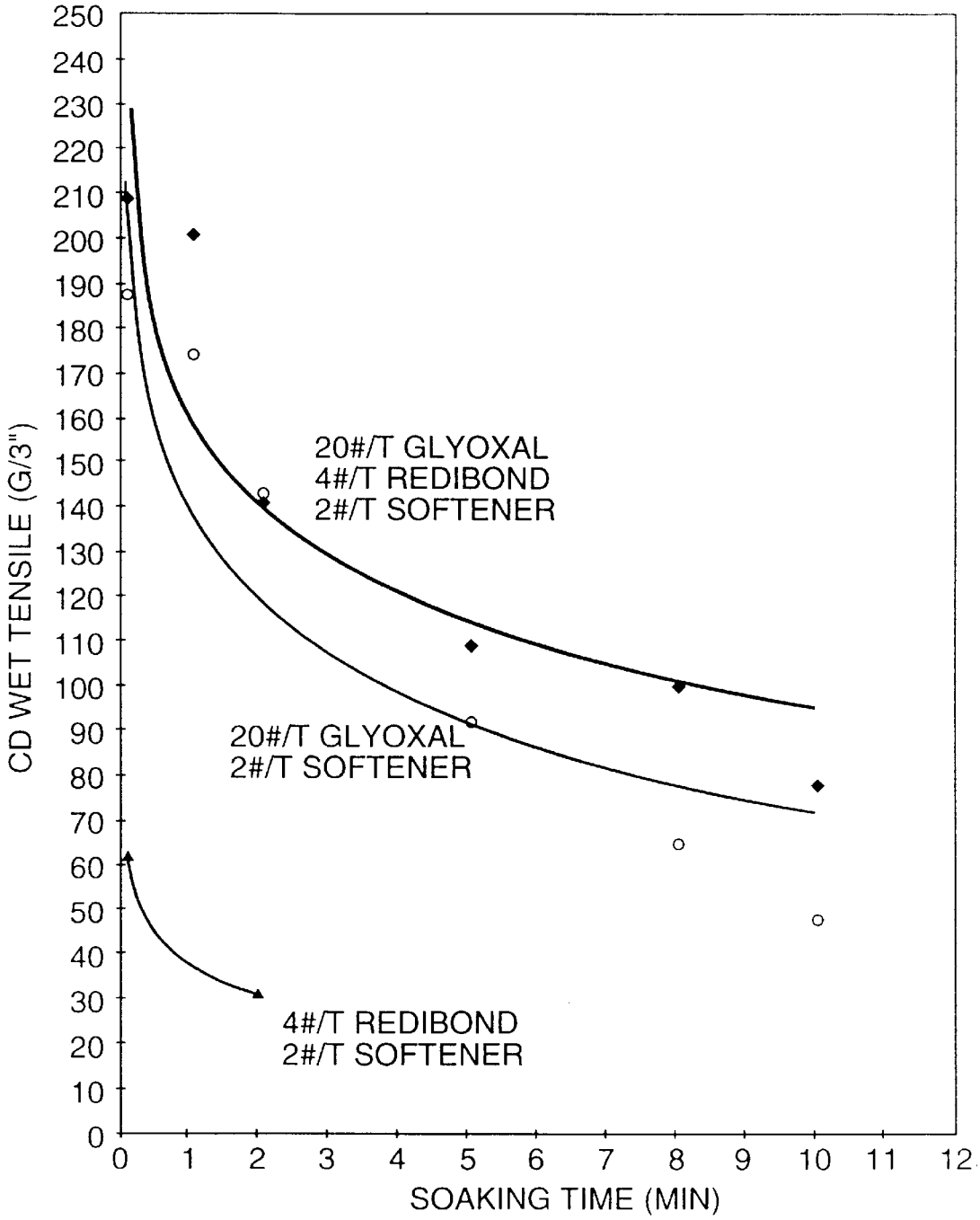
FIG. 9 is a graph showing the advantageous wet strength properties obtained when glyoxal and starch were applied on one ply tissue, measured as Finch Cup CD wet tensile versus time.
Figure 10:
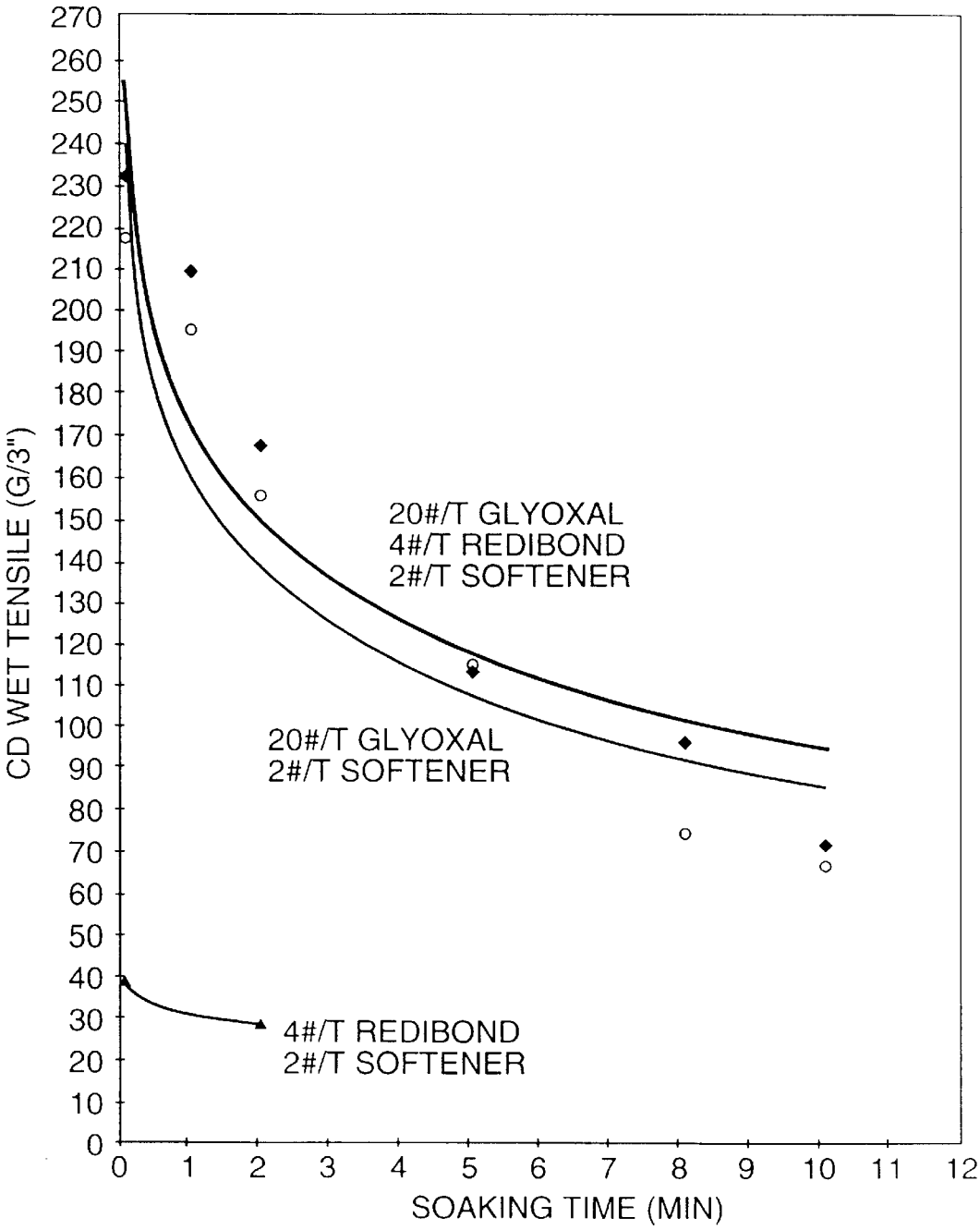
FIG. 10 is a graph showing the advantageous wet strength properties obtained when glyoxal and starch were applied on two ply tissue, measured as Finch Cup CD wet tensile versus time.

FIGS. 9 and 10 are graphs showing the advantageous wet strength properties obtained when glyoxal and starch are applied on one and two ply tissue. These properties are measured on Finch Cup CD wet tensile versus time.

Primary wet strength agents of interest in the present invention are dialdehydes, aldehyde moieties containing polyols, water soluble polymers and cyclic ureas applied to the web before or after the pressing roll (16). However, in creating the desired tissue characteristics, starch may be used as a strength enhancing agent. When utilizing cationic aldehydic starches, such as Co-Bond (R)1000, addition preferably to the softwood kraft furnish or the mixture of softwood and recycle furnish after the furnish is first prepared in the machine chest. By allowing the longer cellulose fibers in the softwood kraft furnish to react with the starch, the temporary wet strength can be brought into the desired range. In a preferred embodiment, the starch is contacted primarily with the softwood fibers while the hardwood fibers are contacted primarily with the cationic nitrogenous softener/debonder. In an alternative embodiment, the cationic aldehydic starch may be added to the overall furnish first and the cationic nitrogenous softener/debonder added after the starch has had time to react with the furnish. However, in one process of the present invention in which the wet strength agents, such as water soluble dialdehydes, and aldehyde moieties containing polyols and cyclic ureas, are added to the web before or after the pressing roll (16), the place of addition of the cationic starch is not critical as long as it is added with the furnish and in some circumstances should not be added at the same place where the cationic softener/debonder is added.

Figure 11:
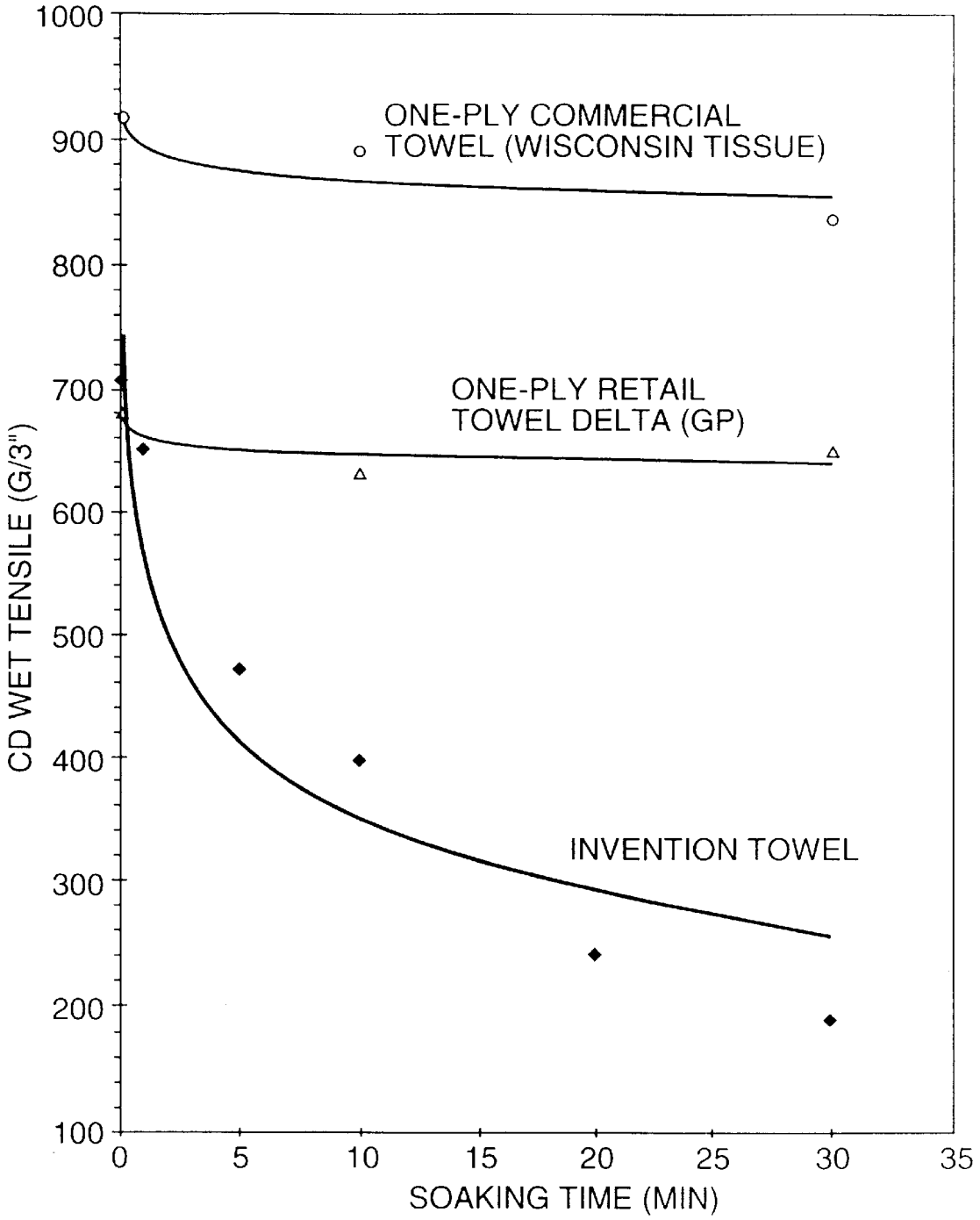
FIG. 11 is a graph showing that advantageous wet strength properties were obtained when glyoxal and starch was applied on a one ply towel.

FIG. 11 is a graph showing that advantageous wet strength properties when glyoxal and starch were utilized in the manufacture of the towel.

Brand Ch is a premium tissue which is currently available in most grocery stores. The tissue apparently does contain a temporary wet strength agent consisting of cationic aldehydic starch. However, patent numbers on the tissue package suggest that the tissue is made by means of a through air drying technique. In addition, the structure of the tissue seems to be consistent with through air drying particularly as the exterior surface, as illustrated in FIG. 4, is covered with a large number of fibers projecting therefrom. As discussed above, when attempts were made to use the Brand Ch tissue in a premoistened condition, the tissue pilled or shredded, producing small balls of fibers when rubbed. Thus, even though Brand Ch possesses a degree of initial CD wet tensile strength, this particular product should not normally be considered desirable for use in a premoistened condition.

Brand Q is a premium tissue which is made by the assignee of the present invention and is currently available in most grocery stores. This particular tissue does not contain any wet strength resin so both the initial and long term CD wet tensile strengths are quite low.

Figure 12:
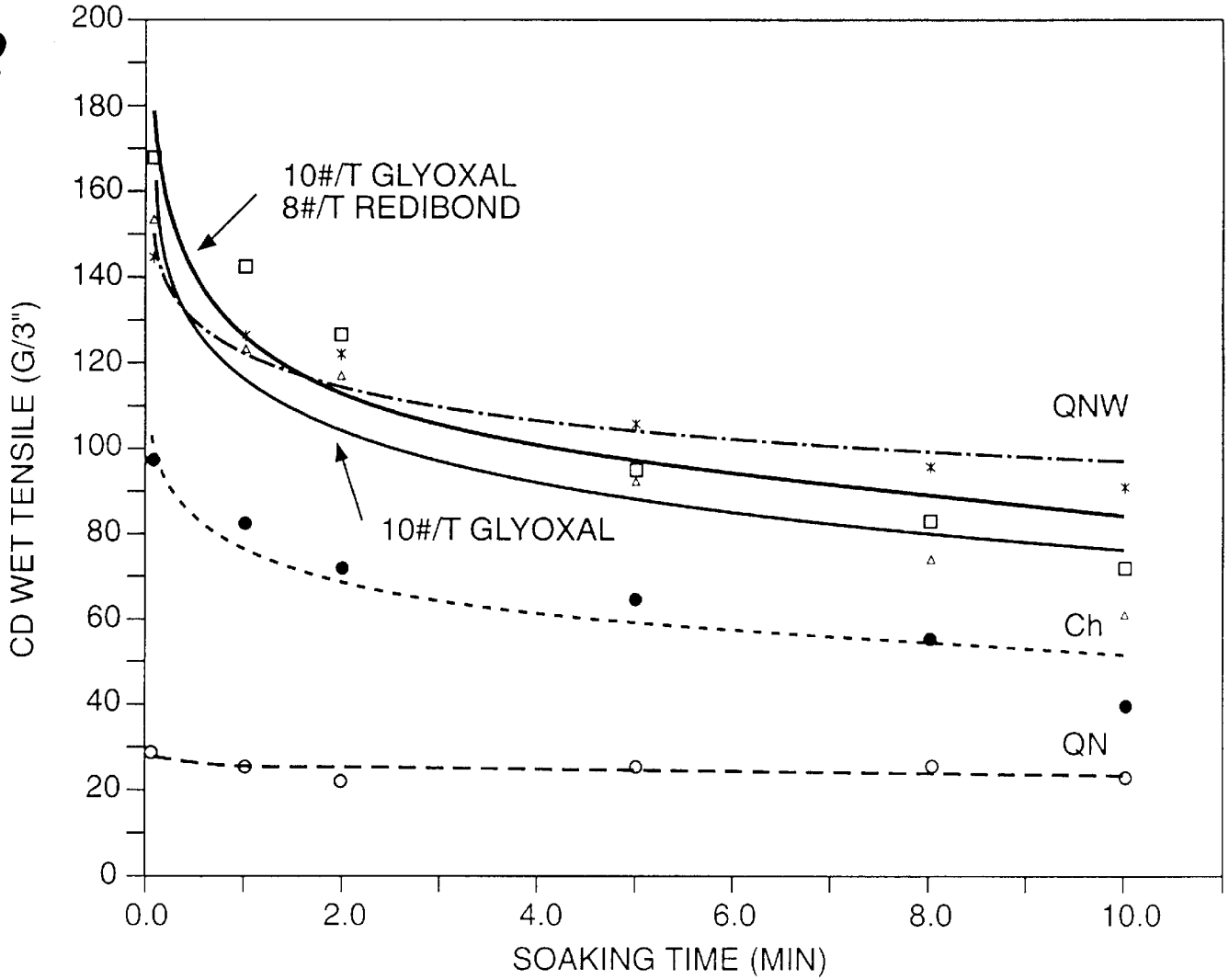
FIG. 12 is a graph comparing Finch Cup decay of the tissue of the present invention with commercial tissue.
Figure 13:
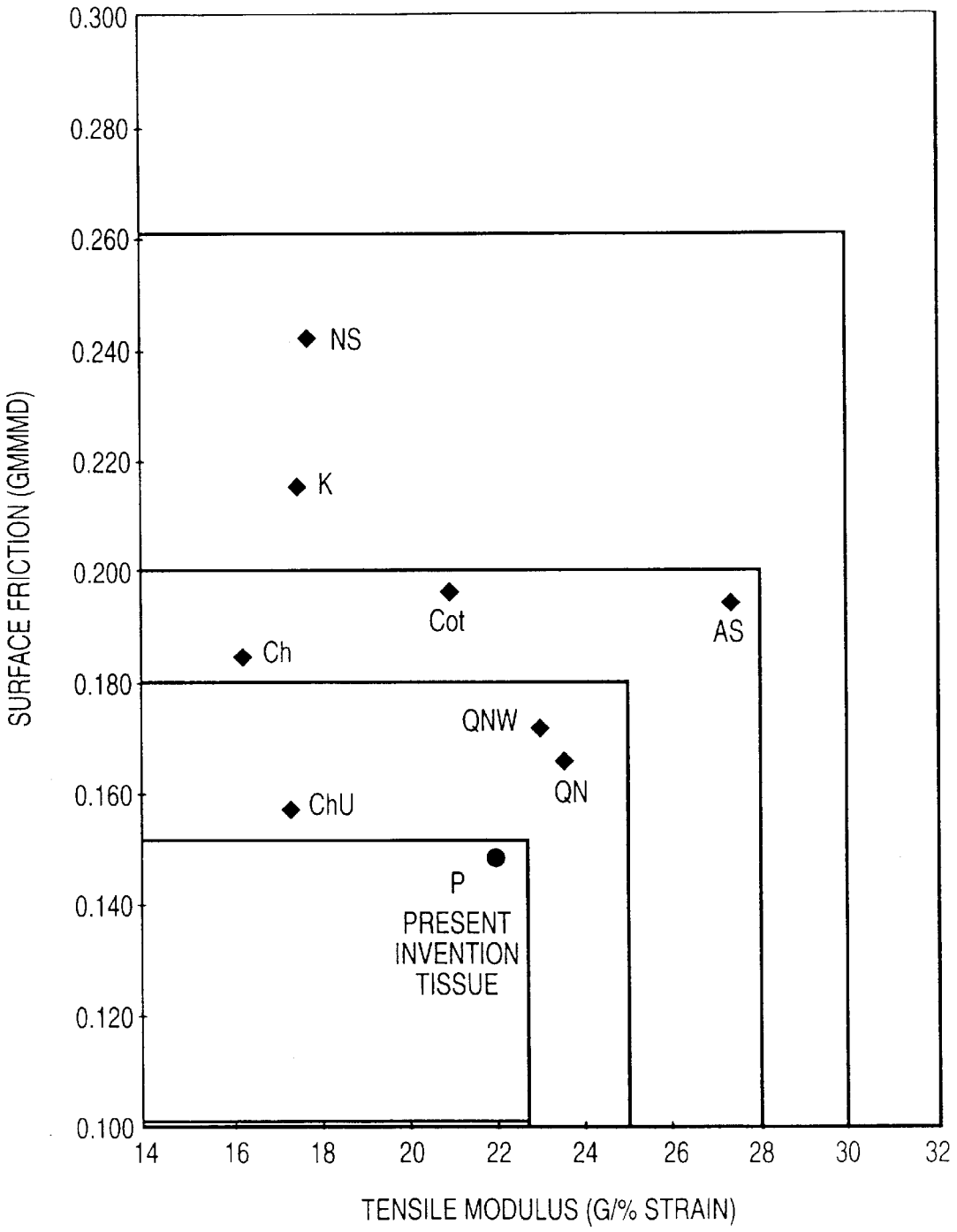
FIG. 13 is a graph comparing the softness of the tissue of the present invention with commercial tissue.

In FIGS. 12 and 13, the properties of Brand Ch and Brand Q are compared to the properties of the tissue of the present invention. The most preferred initial cross-machine direction wet tensile strength for a tissue of the present invention is about above 160 g/3 inches when the tissue is drawn after five seconds of immersion in a Finch Cup testing fixture; a suitable range is about 150–170 g/3 inches. Within about 10 minutes after immersion, the CD wet tensile decreases to about ½ of the initial value. Over time, the cross-machine direction wet tensile strength dissipates.

The initial normalized CD wet tensile strength should be at least about 75 g/3 inches for a tissue made according to the present invention when a tissue is immersed in a Finch Cup testing fixture and drawn after five seconds. For flushable toweling, the initial normalized CD wet tensile is preferably at least about 250 g/3 inches. More preferably for toweling, the initial normalized CD wet tensile will exceed 400 g/3 inches, most preferably over 500 g/3 inches. After immersion in water for a period of ten minutes, CD wet tensile for toweling should drop to less than about ½ of the initial value.

Figure 14:
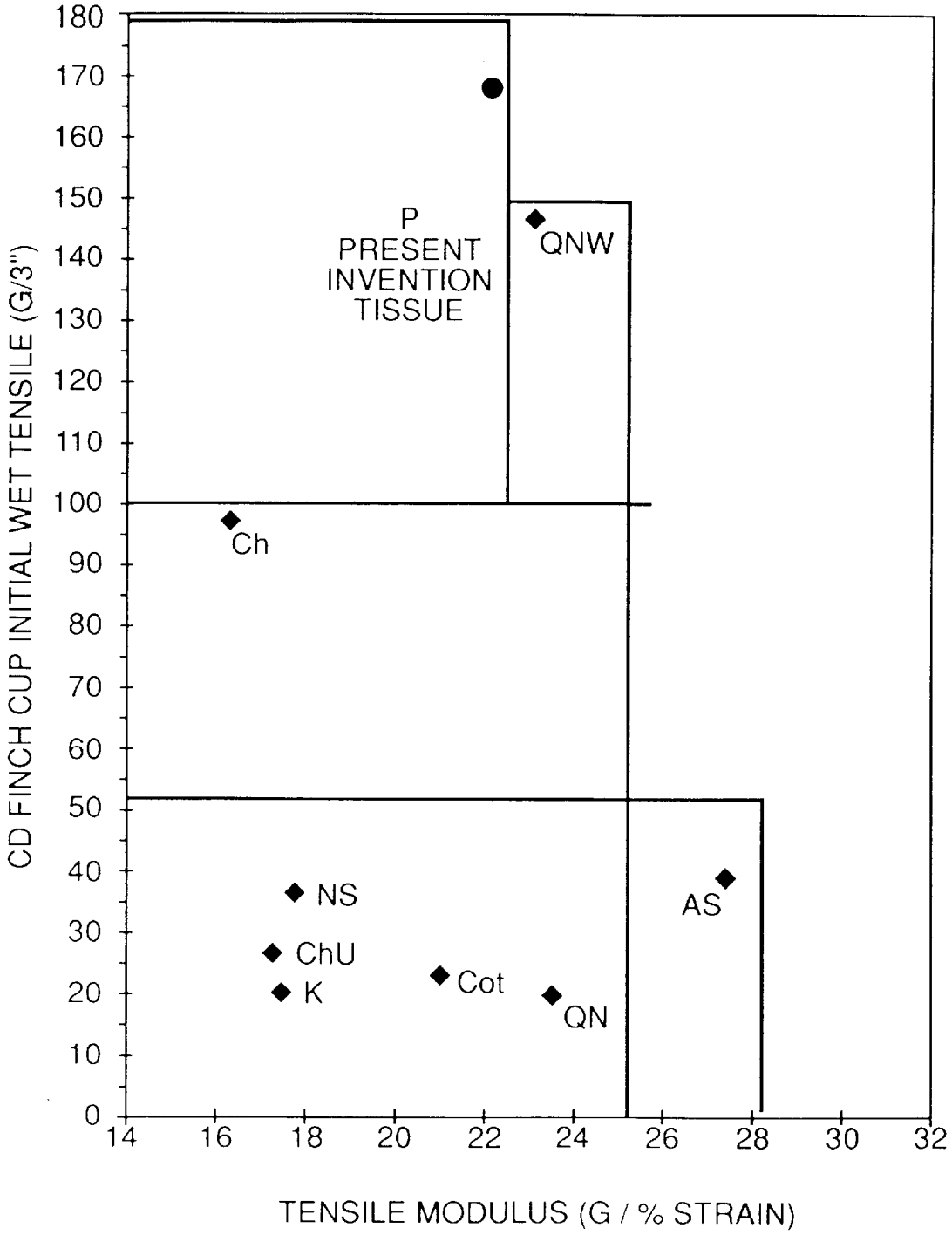
FIG. 14 is a graph comparing the Finch Cup initial tensile and tensile modulus of the tissue of the present invention with commercial tissue.
Figure 15:
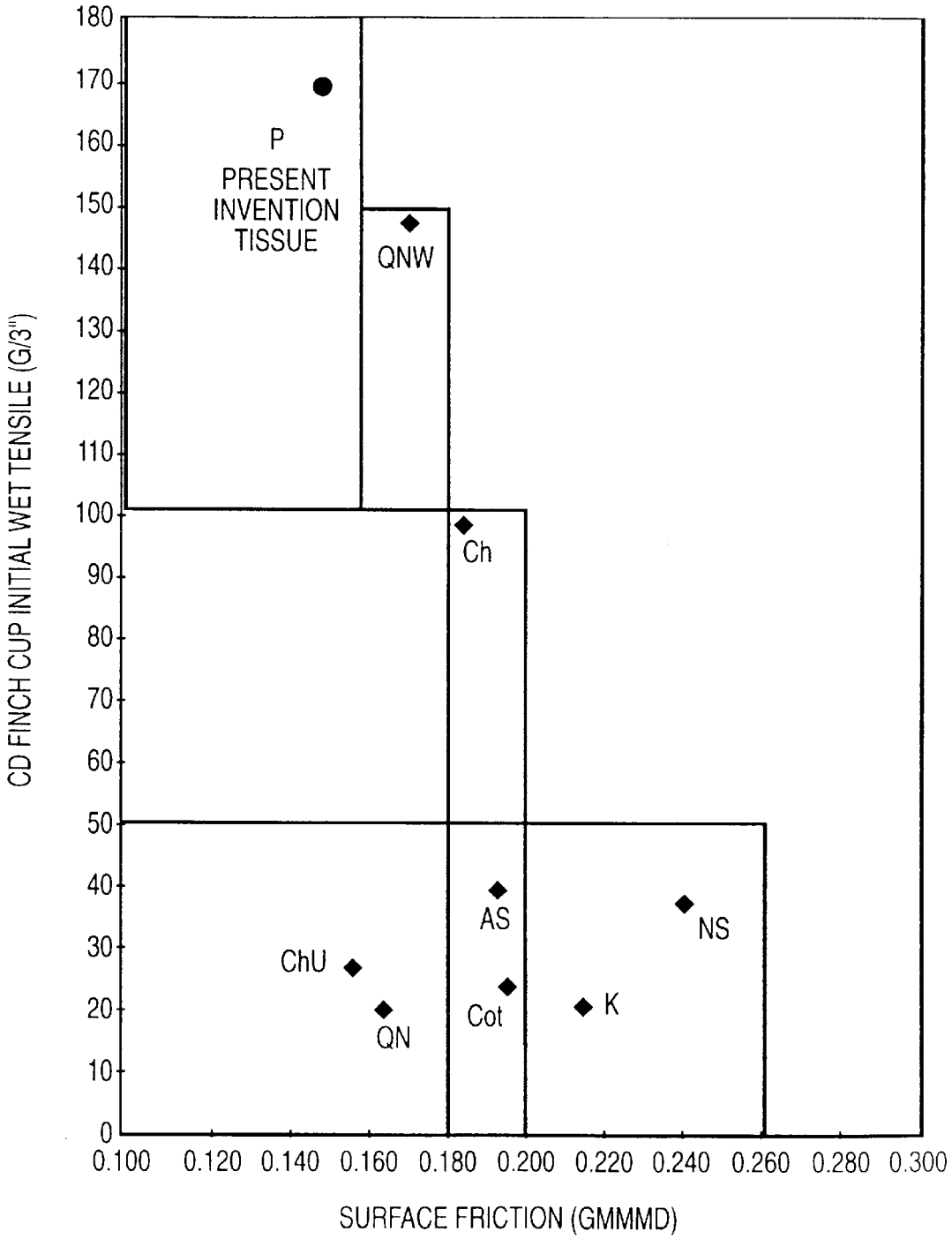
FIG. 15 is a graph comparing the Finch Cup wet tensile and surface friction of the tissue of the present invention with commercial tissue.

FIGS. 14 and 15 illustrate that the tissue of the present invention has the best initial wet strength of any product on the market yet is very soft as shown by a tensile modules below 23 grams/% strain and a surface friction below 0.15 GM MMD.

Figure 16:
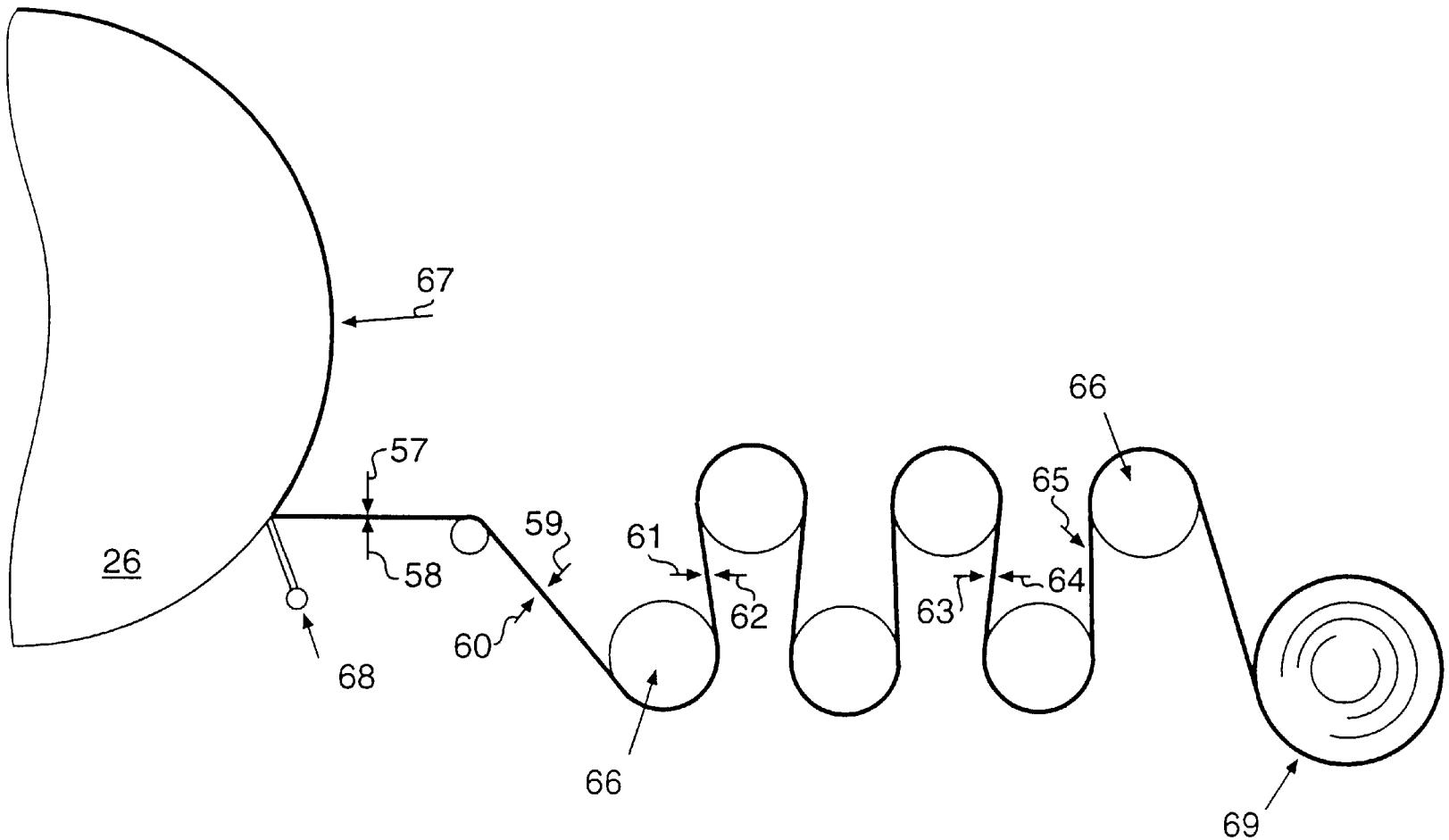
FIG. 16 is a drawing showing the positions at which the uncharged chemical moiety is sprayed in the wet crepe process.

The wet crepe process is illustrated in FIG. 16. In that process, tissue sheet (67) is creped from Yankee dryer (26) using crepe blade (68). The moisture content of the web contacting the creping blade (68) is usually in the range of 15 to 85 percent, preferably 35 to 75 percent. After the creping operation, the drying process is completed by use of one or more steam-heated air dryers (66*a*–66*f*). These dryers are used to reduce the moisture content to its desired final level, preferably from 2 to 8 percent. The completely dried sheet is then wound on reel (69). The wet strength agent is sprayed at the points 57, 59, 60, 61, 62, 63, 64 and 65.

When utilizing aliphatic dialdehydes such as glyoxal as temporary wet strength agents to extend the temporary wet strength properties after moistening, but prior to use, it is preferred that the uncharged temporary wet strength agents be used in combination with conventional cationic starches which are mixtures of amylose and amylopectin.

Advantageous wet strength properties for tissue are obtained when using certain aliphatic aldehydes such as glyoxal, cyclic ureas or polyols containing glyoxal, with a refined furnish. Starch need not be used when the furnish is refined but is useful when unrefined furnish is utilized.

In our process, the usual conventional papermaking fibers are suitable. We utilize softwood, hardwood, chemical pulp obtained from softwood and/or hardwood chips liberated into fiber by sulfate, sulfite, sulfide or other chemical pulping processes. Mechanical pulp was obtained by mechanical treatment of softwood and/or hardwood chips, recycle fiber and refined fiber.

Papermaking fibers used to form the soft absorbent products of the present invention include cellulosic fibers commonly referred to as wood pulp fibers, liberated in the pulping process from softwood (gymnosperms or coniferous trees) and hardwoods (angiosperms or deciduous trees). The particular tree and pulping process used to liberate the tracheid are not critical to the success of the present invention. Cellulosic fibers from diverse material origins may be used to form the web of the present invention, including non-woody fibers liberated from sabai grass, rice straw, banana leaves, paper mulberry (i.e. bast fiber), abaca leaves, pineapple leaves, esparto grass leaves, and fibers from the genus Hesperaloe in the family Agavaceae. Also recycled fibers which may contain any of the above fibers sources in different percentages can be used in the present invention.

Papermaking fibers can be liberated from their source material by any one of the number of chemical pulping processes familiar to one experienced in the art including sulfate, sulfite, polysulfite, soda pulping, etc. The pulp can be bleached if desired by chemical means including the use of chlorine, chlorine dioxide, oxygen, etc. Furthermore, papermaking fibers can be liberated from source material by any one of a number of mechanical/chemical pulping processes familiar to anyone experienced in the art including mechanical pulping, thermomechanical pulping, and chemi thermomechanical pulping. These mechanical pulps can be bleached, if one wishes, by a number of familiar bleaching schemes including alkaline peroxide and ozone bleaching.

Generally in our process the range of hardwood to softwood varies from 0–100% to 100% to 0. The preferred range for hardwood to softwood is about 20 to 80 to about 80 to 20; the most preferred range of hardwood comprises about 40 to about 80 percent of the furnish and the softwood comprises about 60 to about 20 percent of the furnish.

Depending on the basis weight of the furnish and conventional processing steps applied to the web, the paper product may be used as a tissue, a towel, a facial tissue, a napkin or a baby wipe.

EXAMPLES

The following examples exemplify the practice of the present invention. It will be appreciated by those skilled in the art that these examples are not to be construed as limiting the present invention, which is defined by the appended claims.

Example 1

Examples 2 through 30 had the following machine conditions:

A furnish of 50 percent southern softwood kraft and 50 percent southern hardwood kraft was prepared. Water soluble dialdehyde as a temporary wet strength resin was added to the web as indicated in each individual example. The starch, if used, was added to the furnish. The pH in the headbox was from about 6.5 to 7.5, more precisely between 6.5 and 7.0. The paper making machine was configured as a crescent former having a 12 ft. Yankee dryer (26) operating at a speed of 3,252 feet per minute.

Calendering was utilized to control the caliper to approximately 29–35 mils per eight sheets, preferably 31–33 mils. Two base sheets were embossed together air side to air side to form a two ply tissue having a basis weight as shown in each example. Also single ply tissue was formed. The reel crepe for these examples was 23%. The moisture content was 4%. The crepe blade bevel was 0° and the crepe angle was 73°. In all these examples the crepe adhesive was HOUGHTON® 8296 epichlorohydrin and the release agent was HOUGHTON® 8302, softener or phosphate surfactant.

Examples 2, 3, 4 and 5

Examples 2, 3, 4 and 5 illustrate the preferred mode for spraying the dialdehyde on the web.

In these examples the process conditions were the same as in Example 1 except that in Example 2 no glyoxal was added to the sheet while in Examples 3, 4 and 5 twenty pounds of glyoxal for each ton of fiber in the furnish was sprayed either before the pressing roll (16) at position (53), as was done in Example 3, or after the pressing roll (16) at position (52), as is shown in Example 4, or directly on the Yankee (26) drying surface at position (51) as shown in Example 3. The results are summarized in Table 1 and indicate that when the glyoxal was sprayed after the pressing roll (16) the Wet/Dry percent was 30; when the glyoxal was sprayed before the pressure roll (16) the Wet/Dry percent was 21; and when glyoxal was sprayed directly on the Yankee (26) surface, the Wet/Dry percent was 19; for the control the Wet/Dry percent was 11.

When glyoxal was sprayed after the pressing roll (16) on the air side of the sheet, the wet GMT in grams per three inches was 199, while this value was 131 when glyoxal was sprayed before the pressing roll (16). The wet GMT in grams per three (3) inches was 150 when glyoxal was sprayed directly on the Yankee (26) and the wet GMT in grams per three (3) inches was 77 for the control. Further data are set forth in Table 1.

TABLE 1

Examples 2–5: Spray position performance

| Example # | Glyoxal treatment* | Spray Position | Dry GMT (G13") | Wet GMT (G13") | Wet/Dry (%) |
|---|---|---|---|---|---|
| 2 | Control A untreated | None | 694 | 77 | 11 |
| 3 | 20#/T Glyoxal | Before Pressing Roll 16 | 628 | 131 | 21 |
| 4 | 20#/T Glyoxal | After Pressing Roll 16 at position 52 as shown in FIG. 2 | 659 | 199 | 30 |
| 5 | 20#/T Glyoxal | On the Yankee 26 at position 51 as shown in FIG. 2 | 777 | 150 | 19 |

*pound per ton of fiber in the furnish

Examples 6–9

Examples 6, 7, 8 and 9 demonstrate the effectiveness of the chargeless dialdehyde wet strength agent and its use in combination with starch.

In Examples 6, 7, 8 and 9 the process conditions were the same as in Example 1 except that in Examples 6 and 7 no glyoxal was added to the sheet while in Examples 8 and 9 ten pounds of glyoxal per ton of fiber in the furnish was sprayed after the pressing roll (16) at position (52) as shown in FIG. 2. In Example 9, starch was added to the furnish. The results are summarized in Table 2 and illustrate that when the glyoxal was sprayed after the pressing roll (16), and starch was added to the furnish the Wet/Dry percent was 28. For the control this value was 11. When refined furnish was used and only glyoxal was sprayed, the Wet/Dry percent was 25. Further data is set forth in Table 2. Example 9 illustrates that when glyoxal was used in combination with starch the wet GMT grams per three (3) inches improved significantly based on an unrefined furnish.

TABLE 2

Example 6–9: Glyoxal spray (after pressing roll) and "glyoxal spray/starch wet-end" combination.

| Example # | Temporary Wet Strength Agent | Refining (HP) | BW (#/Ream) | Dry GMT (G/3") | Wet GMT (G/3") | Wet/Dry (%) | Friction* GM MMD | Modules* G/% Strain |
|---|---|---|---|---|---|---|---|---|
| 6 | Control A | 36 | 19.10 | 694 | 77 | 11 | 0.163 | 19.46 |
| 7 | Control B 8#/T Redibond 5320 | None | 18.79 | 632 | 70 | 11 | 0.154 | 17.54 |
| 8 | 10#/T Glyoxal | 36 | 18.96 | 686 | 171 | 25 | 0.155 | 20.81 |

TABLE 2-continued

Example 6–9: Glyoxal spray (after pressing roll) and "glyoxal spray/starch wet-end" combination.

| Example # | Temporary Wet Strength Agent | Refining (HP) | BW (#/Ream) | Dry GMT (G/3") | Wet GMT (G/3") | Wet/Dry (%) | Friction* GM MMD | Modules* G/% Strain |
|---|---|---|---|---|---|---|---|---|
| 9 | 10#/T Glyoxal 8#/T Redibod 5320 | None | 18.85 | 665 | 185 | 28 | 0.149 | 21.95 |

Surface roughness was evaluated by measuring geometric mean deviation in the coefficient of friction using a Kawabata KES-SE Friction Tester equipped with a fingerprint-type sensing unit using the low sensitivity range. A 25 stylus weight is used, and the instrument readout is divided by 20 to obtain the mean deviation in the coefficient of friction. The geometric mean deviation in the coefficient of friction (GM MMD) is then the square root of the product of the deviation in the machine direction andthe cross-machine direction, hereinafter it is referred to as friction.

Examples 10–13

Examples 10, 11, 12, and 13 demonstrate the effectiveness of the dialdehyde and cyclic urea as temporary wet strength agents. Examples 12 and 13 also demonstrate the effectiveness of using the dialdehyde or cyclic urea with starch. The process conditions of Example 1 were used in these examples. When the dialdehyde or cyclic urea was combined with starch the Wet/Dry percent was in the range of 25–35. Further details for each of the examples are set forth in Table 3. The highest Wet/Dry percent values were obtained when glyoxal and starch or when cyclic ureas and starch were used with unrefined furnish or when glyoxal was used with refined furnish.

TABLE 3

Examples 10–13: set forth the advantageous physical properties of tissue treated with wet strength agents having no charge such as dialdehydes and polyois or combinations of dialdehyde and aldehyde containing cyclic ureas with cationic starch.

| Example # | Temporary Wet Strength Agent | Refining (HP) | BW (#/Ream) | D GMT (G/3") | W GMT (G/3") | Wet/Dry (%) |
|---|---|---|---|---|---|---|
| 10 | 20#/T Glyoxal | 36 | 18.69 | 659 | 199 | 30 |
| 11 | 20#/T Sunrez ® 747 | 36 | 18.72 | 557 | 113 | 20 |

TABLE 3-continued

Examples 10–13: set forth the advantageous physical properties of tissue treated with wet strength agents having no charge such as dialdehydes and polyois or combinations of dialdehyde and aldehyde containing cyclic ureas with cationic starch.

| Example # | Temporary Wet Strength Agent | Refining (HP) | BW (#/Ream) | D GMT (G/3") | W GMT (G/3") | Wet/Dry (%) |
|---|---|---|---|---|---|---|
| 12 | 20#/T Glyoxal 8#/T Redibond 5320 | None | 18.59 | 654 | 215 | 33 |
| 13 | 20#/T Sunrez ® 747 8#/T Redibond 5320 | None | 18.66 | 508 | 125 | 25 |

Examples 14–18

Examples 14 through 18 illustrate cross directional wet tensile decay versus soaking time. The data in Table 4 illustrates that after 10 minutes of soaking in tap water, more than one half the wet strength has dissipated. This feature is important in preventing the clogging of toilets and septic systems. The process conditions of Example 1 were utilized in treating the web with the wet strength agents.

TABLE 4

Examples 14–18: CD Wet Tensile decay versus soaking time.

| # | Temporary Wet Strength Agent | BW (#/Ream) | Dry GMT (G/3") | Finch cup Wet CD tensile (G/3") tapwater 5 Sec | 1 Min | 5 Min | 10 Min | (%) Wet CD lost at 10 min.[b] |
|---|---|---|---|---|---|---|---|---|
| 14 | Control A untreated | 19.1O | 694 | 29.2 | 26.2 | 25.2 | 24.5 | — |
| 15 | Control C 9#/T Co-Bond ® 1OOO | 19.06 | 918 | 147.2 | 127.6 | 106.3 | 90.9 | 38.2% |
| 16 | 1O#/T Glyoxal | 18.96 | 686 | 155.O | 123.5 | 94.2 | 62.O | 60% |
| 17 | 1O#/T Glyoxal 8#/T Redibond 5320 | 18.85 | 665 | 169.O | 142.7 | 96.1 | 72.8 | 56.9% |
| 18 | 20#/T Sunrez ® 747 8#/T Redibond 5320 | 18.66 | 508 | 104.9 | 96.8 | 60.9 | 39.8 | 62.O% |

[a]FCT was conducted in tap water $$^{(b)}(\%)\ \text{Wet CD Lost} = \frac{[\text{Initial WCD (5 sec)} - \text{WCD (times)}] \times 100}{\text{Initial WCD (5 sec)}}$$

Examples 19–26

Examples 19 through 24 illustrate that according to this invention the dry and wet strength of the tissue can be independently regulated by controlling the amount of starch and dialdehyde present in the reaction system. To have a good wet/dry percent the weight ratio of the dialdehyde to the starch is suitably controlled to a ratio of about 5:1 preferably 2:1.

TABLE 5

Examples 19–26: Illustrate the independent regulations of wet and dry strength of the tissue utilizing glyoxal and starch.

| # | Temporary Wet Strength Agent | Refining (HP) | BW (#/ream) | Dry GMT (G/3") | Wet GMT (G/3") | Wet/Dry (%) |
|---|---|---|---|---|---|---|
| 19 | 10 #/T glyoxal | 36 | 18.96 | 686 | 171 | 24.9 |
| 20 | 20 #/T glyoxal | 36 | 18.69 | 659 | 199 | 30.2 |
| 21 | 30 #/T glyoxal | 36 | 18.54 | 640 | 223 | 34.8 |
| 22 | 10 #/T glyoxal 8 #/T Redibond 5320 | None | 18.85 | 665 | 185 | 27.8 |
| 23 | 20 #/T glyoxal 8 #/T Redibond 5320 | None | 18.59 | 645 | 215 | 33.3 |
| 24 | 30 #/T glyoxal 8 #/T Redibond 5320 | None | 18.66 | 711 | 240 | 33.7 |
| 25 | 6 #/T Co-Bond ® 1000 | 30 | 18.65 | 734 | 139 | 18.9 |
| 26 | 9 #/T Co-Bond ® 1000 | 30 | 19.06 | 918 | 183 | 19.9 |

Examples 27–28

Examples 27–28 illustrate the wet strength aging properties achieved after two weeks natural aging of the tissue treated with the dialdehyde or dialdehyde and starch. The results are set forth in Table 6. The wet tensile strength of the tissue produced in Examples 27 and 28 tend to level off after two weeks of natural aging. The data shows that wet strength data developed at a more rapid rate when the aldehyde and starch were used in combination to increase the wet strength of the tissue.

TABLE 6

| # | Temporary Wet Strength Agents | Properties | Aging times 1<Hrs | 24 Hr. | 48 Hr. | 1 Week | 2 Weeks | 3 Weeks |
|---|---|---|---|---|---|---|---|---|
| 27 | 20 #/T Glyoxal (Refining 36 HP) | Dry GMT (G/3") | 665 | 631 | 642 | 675 | 660 | 669 |
| | | Wet GMT (G/3) | 98 | 142 | 147 | 171 | 204 | 195.5 |
| | | Wet/Dry (%) | 14.7 | 22.5 | 22.9 | 25.3 | 30.4 | 29.2 |
| 28 | 20 #/T Glyoxal 8 #/T Redibond (Non Refining) | Dry GMT (G/3") | 666 | 655 | 687 | 691 | 672 | 654 |
| | | Wet GMT (G/3") | 109 | 157 | 167 | 191 | 226 | 210 |
| | | Wet/Dry (%) | 16.4 | 24 | 24.3 | 27.6 | 33.6 | 32.1 |

Example 29

A commercially purchased tissue ("Brand Ch") manufactured by the assignee of U.S. Pat. Nos. 5,217,576 and 5,240,562 were subjected to a wet abrasion test as described above. This tissue and its brand-mates seem to be the only major bathroom tissues on the market having wet strength approaching the levels required for the practice of this invention. The CD wet tensile of this product typically averages around 84–98 g/3 inches FCT. When subjected to the wet abrasion test, significant pilling was observed on the pigskin after about 2 strokes but the sheets held together, in a gross sense, until about 4 strokes when a very high level of pilling is observed with the pills being quite large and often leading to failure.

FIG. 5A is a photomicrograph taken at 6× illustrating the pills observed on this tissue after 3 strokes. FIG. 5B is a photomicrograph taken at 6× illustrating the pills observed on the pigskin after 3 strokes.

Accordingly, it can be appreciated that if extra cleaning ability is desired, this tissue and the others are not really well suited to be used in a premoistened condition as the detritus left behind by the pilling will seriously detract from the desired extra cleansing.

Example 30

A variety of some of the more commercially significant bathroom tissue brands on the market were subjected to the FCT. All of these tissues had basis weights in the range of around 17 to 20 lbs/3000 sq ft ream. As can be seen from the results set out in Table 7, only Charmin—brand Ch—has a CD wet tensile approaching the level required for best practice of the present invention.

TABLE 7

| Bathroom Tissue/Code | Finch Cup CD Wet Tensile Strength Grams/3" Width |
|---|---|
| Tissue of Present Invention-P | 169.0 |
| Quilted Northern ®-QN | 19.5 |
| Marina ® | 25.5 |
| Nice 'n Soft-NN | 36.6 |
| Charmin ®-Ch | 98.0 |
| Charmin ® Ultra-ChU | 26.4 |
| Kleenex ®- | 20.1 |
| Cottonelle ® Two-Ply-Cot | 23.0 |
| Angel Soft ®-AS | 39.0 |
| Quilted Northern ®-QNW | 147.2 |

Examples 33 through 44 relate to towels having temporary wet strength.

Example 31

Examples 31, 36, 39 and 42 had the following machine conditions:

A furnish of 60 percent southern softwood kraft and 40 percent southern hardwood kraft was prepared. Water soluble dialdehyde was added to the web as indicated in each individual example. The starch, if used, was added to the furnish. The pH in the head box was maintained from about 6.5 to 7.5, more precisely between 6.5 to 7.0. The paper making machine utilized had a 3 ft. Yankee dryer (26) operating at a speed of 80 feet per minute.

The reel crepe in these examples was 20%. The moisture content was 4%. The crepe blade bevel was 0° and the crepe angle was 73°. In all these examples the adhesive was HOUGHTON® 8296 epichlorohydrin and the release agent was HOUGHTON® 565.

Examples 32–36

Examples 32, 33, 34, 35 and 36 demonstrate the importance of applying the dialdehyde to the paper sheet before or after the pressing roll (16) as shown in FIG. 2. These examples illustrate that the one ply towel (Example 36) prepared according to the process of Example 31 had excellent wet strength properties which were equal to or better than the best two ply premium towels. The towels of this invention exhibited a much better wet strength and percent wet strength over dry strength ratio as compared to conventional one ply towels. Further details are set forth in Table 8.

TABLE 8

Examples 32–36. Data comparing the towel of this invention with premium retail towel and commercial towel.

| # | Commercial Towels and Towel of this invention (Example 36) | BW (#/ream) | Call per (.001"/8 ply) | Dry GMT (G/3") | | hc,32 Wet GMT (G/3") | Wet/Dry (%) | Modulus ABS (G/% Str.) (G/G) |
|---|---|---|---|---|---|---|---|---|
| 32 | Extra Durable Bounty (P & G) 2 Ply - TAD Process | 25.9 | 175.2 | 2623 | 950 | 36 | 30.9 | 11.51 |
| 33 | Bounty (P & G) 2 Ply - TAD Process | 25.9 | 163.1 | 2037 | 690 | 34 | 29.3 | 11.26 |
| 34 | Delta (GP) 1 Ply - Conventional Process | 24.8 | 146 | 2324 | 545 | 23.5 | 52.6 | 2.35 |
| 35 | Wisconsin Tissue 1902 1 Ply - Conventional Process | 27.5 | 56.1 | 4376 | 714 | 16 | 188.3 | 2.23 |
| 36 | 30#/T Glyoxal+4 #/T Redibond +2 #/T Softener 1 Ply - CWR Process | 21.7 | 83.2 | 2481 | 841 | 34 | 45 | 3.7 |

Examples 32 & 33 were premium retail towels.
Example 34 is a retail towel.
Example 36 is commercial towel.

Examples 37–39

Examples 37 and 38 are conventional towels. The towel of Example 39 was prepared as set forth in Example 31 and the data set forth in Table 9 show that the towel of this invention has better wet strength decay than conventional towels.

TABLE 9

Examples 37–39: CD wet tensile decay of the towel of this invention compared to conventional towels.

| # | Commercial Towels and Towels of this Invention (Example 35) | BW (#/r) | Dry GMT (G/3") | Finch Cup CD Wet Tensile (G/3") 5 Sec. | 1 Min. | 5 Min. | 10 Min. | 30 Min. | (%) Wet CD lost at 10 min.[b] |
|---|---|---|---|---|---|---|---|---|---|
| 37 | Delta (GP)- 1 Ply Permanent Wet Strength | 24.8 | 2324 | 680 | — | — | 629.5 | 648.2 | 7.4% |
| 38 | Wisconsin tissue 1902 1 Ply Permanent Wet | 27.5 | 4376 | 917.5 | — | — | 88.9 | 834.9 | 3.1% |
| 39 | 1 Ply Temporary Wet Strength Towel of This Invention | 21.7 | 2481 | 706.3 | 650.5 | 472.4 | 242.3 | 188.7 | 65.7% |

[a](%) Wet CD Lost = $\frac{(W - WT)}{W} \times 100$

W: Initial CD wet tensile (5 sec. soaking)
WT: CD wet tensile (after T time soaking).
[b]FCT was conducted with tap water Examples 40–42

The towels of Examples 40 and 41 are commercially available. The towels of Example 42 was prepared as set forth in Example 31 the data in Table 10 show that the towel of this invention has a higher wet strength and breaks down easier in the water than conventional towels.

TABLE 10

Examples 40–42: Dispersibility of and pigskin data of the towel of this invention versus conventional towels.

| # | Commercial Towels and Towels of this invention (Example 42) | BW (#/r) | Dry GMT (G/3") | Wet GMT (G/3") | Break Up Times (Bottle Shake Test in Water pH = 8.5 | PigSkin Test Fiber Pilling | PigSkin Test Sheet Shredding |
|---|---|---|---|---|---|---|---|
| 40 | Delta (GP) - 1 Ply | 24.8 | 2324 | 545 | Did not break up after 12 Min | After 56 Strokes | After 56 Strokes |
| 41 | Wisconsin tissue 1902 1 Ply Permanent Wet Strength | 27.5 | 4376 | 714 | Did not break up after 12 Min. | After 26 Strokes | After 56 strokes |
| 42 | 1 Ply Temporary Wet Strength Towel of This Invention | 21.7 | 2481 | 841 | 160 Sec. | After 32 strokes | After 56 strokes |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dispersible tissue product having a glabrous surface and being adapted both for use in a dry condition and for use in a premoistened condition, said tissue having temporary wet strength and comprising a water soluble aldehyde containing temporary wet strength agent including uncharged water soluble chemical moieties the amount of said water soluble temporary wet strength agent being sufficient to produce an initial normalized CD wet tensile strength of at least about 75 g/3 inch strip 5 seconds after wetting as measured by the Finch Cup method; said tissue exhibiting a subsequent CD wet tensile, as measured 10 minutes after immersion, of less than about ½ of the initial CD wet tensile strength; said paper product in a moistened condition exhibiting a Wet Abrasion Resistance Number of at least about 4.

2. The tissue of claim 1, wherein the initial normalized CD wet tensile strength of said tissue is in excess of at least about 105 g/3 inch strip 5 seconds after immersion.

3. The tissue of claim 2, wherein the tensile modulus of the tissue is controlled within the range of less than 32 g/% strain, and the GM MMD of the tissue is controlled to less than 0.23.

4. The tissue of claim 2, wherein the wet abrasion resistance number of the tissue exceeds 8.

5. The tissue of claim 1, wherein the tensile modulus of the tissue is controlled within the range of less than 28 g/% strain, and the GM MMD of the tissue is controlled to less than 0.26.

6. The tissue of claim 1, wherein the amounts of said temporary wet strength agent added is controlled to produce a ratio of cross direction wet tensile strength to cross direction dry tensile strength of over at least about 20%.

7. The tissue of claim 6, wherein processing and calendering of said tissue is controlled to produce a GM MMD friction of from about 0.100 to 0.185 and a modulus of from about 23.5 to 10 g/% strain.

8. The tissue of claim 1, wherein the amount of said temporary wet strength agent added is controlled to produce a ratio of cross direction wet tensile strength to cross direction dry tensile strength of over at least about 22%.

9. The tissue of claim 1, wherein processing and calendering of said tissue is controlled to produce a GM MMD friction of from about 0.120 to 0.175 and a modulus of from about 22.5 to 10 g/% strain.

10. The tissue of claim 1, wherein the tensile modulus of the tissue is controlled within the range of less than 32 g/% strain, and the GM MMD of the tissue is controlled to less than 0.23.

11. The tissue of claim 1, wherein the amount of the wet strength agent added is controlled such that the tensile modulus of the tissue is controlled within the range of less than 26 g/% strain, and the GM MMD of the tissue is controlled to less than 0.185.

12. The tissue of claim 1, wherein the amount of said temporary wet strength agent added is controlled to produce a ratio of cross direction wet tensile strength to cross direction dry tensile strength of over at least about 24%.

13. The tissue of claim 1, wherein the ratio of machine direction dry tensile strength to cross direction dry tensile strength is no more than about 2.5.

14. The tissue of claim 1, wherein the ratio of machine direction dry tensile strength to cross direction dry tensile strength is no more than about 1.9.

15. The tissue of claim 1, wherein the ratio of machine direction dry tensile strength to cross direction dry tensile strength is no more than about 2.2.

16. The tissue of claim 1, wherein the ratio of machine direction dry tensile strength to cross direction dry tensile strength is between about 1.8 and about 2.5.

17. A biodegradable tissue product comprising a cellulosic web dewatered by substantially uniform compaction applied to the web by contact with a dewatering felt and passage through a nip including a suction pressure roll and being adapted both for use in a dry condition as well as premoistened shortly before use said tissue comprising a water soluble wet strength agent including uncharged chemical moieties selected from the group consisting of dialdehydes, aldehyde containing polyols, polymers and cyclic ureas and mixtures thereof the amount of the wet strength agent added being sufficient to produce an initial normalized CD wet tensile strength of at least about 75 g/3 inch strip 5 seconds after immersion as measured by the Finch Cup method and a subsequent CD wet tensile of less than about ½ of the initial CD wet tensile as measured 10 minutes after immersion, said paper product in a moistened condition exhibiting a Wet Abrasion Resistance Number of at least about 4.

18. The tissue of claim 17, wherein the initial normalized CD wet tensile strength of said tissue is in excess of at least about 105 g/3 inch strip 5 seconds after immersion.

19. The tissue of claim 18, wherein the tensile modulus of the tissue is controlled within the range of less than 32 g/% strain, and the GM MMD of the tissue is controlled to less than 0.23.

20. The tissue of claim 19, wherein the tensile modulus of the tissue is controlled within the range of less than 28 g/% strain, and the GM MMD of the tissue is controlled to less than 0.26.

21. A dispersible tissue product having a glabrous surface and being adapted both for use in a dry condition and for use in a premoistened condition, said tissue having temporary wet strength and comprising a water soluble temporary wet strength agent selected from the group of water soluble uncharged aldehydes, aldehyde containing polymers, polyols and cyclic ureas and mixtures thereof and water soluble wet strength enhancing agents, the ratio of said water soluble temporary wet strength agent to the water soluble wet strength enhancing agent being controlled to produce an initial normalized CD wet tensile strength of at least about 75 g/3 inch strip 5 seconds after wetting as measured by the Finch Cup method; said tissue exhibiting a subsequent CD wet tensile, as measured 10 minutes after immersion, of less than about ½ of the initial CD wet tensile strength said paper product in a moistened condition exhibiting a Wet Abrasion Resistance Number of at least about 4.

22. The tissue of claim 21, wherein the water soluble strength enhancing agent is cationic starch.

23. The tissue of claim 22, wherein the cationic starch is in the form of a cationic water soluble organic polymer having aldehyde groups in its moiety.

24. The tissue of claim 22, wherein the initial normalized CD wet tensile strength of said tissue is in excess of at least about 105 g/3 inch strip 5 seconds after immersion.

25. The tissue of claim 22, wherein the tensile modulus of the tissue is controlled within the range of less than 32 g/% strain, and the GM MMD of the tissue is controlled to less than 0.23.

26. The tissue of claim 23, wherein the wet abrasion resistance number of the tissue exceeds 8.

27. The tissue of claim 22, wherein the amounts of said temporary wet strength agent and starch added are controlled to produce a ratio of cross direction wet tensile strength to cross direction dry tensile strength of over at least about 22%.

28. A dispersible tissue product having a glabrous surface and being adapted both for use in a dry condition and for use in a premoistened condition, said tissue having temporary wet strength and comprising a water soluble temporary wet strength agent selected from the group consisting of uncharged aldehydes, aldehyde containing polymers, polyols, and cyclic ureas or mixture thereof, a strength enhancing agent and a softener/debonder, the ratio said water soluble temporary wet strength agent to the strength enhancing agent and the cationic softener/debonder being controlled to produce an initial normalized CD wet tensile strength of at least about 75 g/3 inch strip 5 seconds after wetting as measured by the Finch Cup method; said tissue exhibiting a subsequent CD wet tensile, as measured 10 minutes after immersion, of less than about ½ of the initial CD wet tensile strength, said paper product in a moistened condition exhibiting a Wet Abrasion Resistance Number of at least 4.

29. The tissue of claim 28, wherein the water soluble strength enhancing agent is cationic starch.

30. The tissue of claim 29, wherein the cationic softener/debonder is chosen from the group consisting of imidazolines, amido amine salts, linear amido amines, tetravalent salts, ammonium salts and mixtures thereof.

31. The tissue of claim 30, wherein the initial normalized CD wet tensile strength of said tissue is in excess of at least about 105 g/3 inch strip 5 seconds after immersion.

32. The tissue of claim 29, wherein the tensile modulus of the tissue is controlled within the range of less than 32 g/% strain, and the GM MMD of the tissue is controlled to less than 0.23.

33. The tissue of claim 32, wherein the wet abrasion resistance number of the tissue exceeds 8.

34. The tissue of claim 29, wherein the tensile modulus of the tissue is controlled within the range of less than 28 g/% strain, and the GM MMD of the tissue is controlled to less than 0.26.

35. A dispersible tissue product having a glabrous surface and being adapted both for use in a dry condition and for use in a premoistened condition, said tissue having temporary wet strength and including as the water soluble temporary wet strength agent glyoxal or aldehyde containing cyclic urea, the amount of glyoxal or cyclic urea being sufficient to produce an initial normalized CD wet tensile strength of at least about 75 g/3 inch strip 5 seconds after wetting as measured by the Finch Cup method; said tissue exhibiting a subsequent CD wet tensile, as measured 10 minutes after immersion, of less than about ½ of the initial CD wet tensile strength said paper product in a moistened condition exhibiting a Wet Abrasion Resistance Number of at least about 4.

36. The tissue of claim 35, wherein the initial normalized CD wet tensile strength of said tissue is in excess of at least about 105 g/3 inch strip 5 seconds after immersion.

37. The tissue of claim 36, wherein the tensile modulus of the tissue is controlled within the range of less than 32 g/% strain, and the GM MMD of the tissue is controlled to less than 0.23.

38. The tissue of claim 36, wherein the wet abrasion resistance number of the tissue exceeds 8.

39. The tissue of claim 35, wherein the tensile modulus of the tissue is controlled within the range of less than 28 g/% strain, and the GM MMD of the tissue is controlled to less than 0.26.

40. The tissue of claim 35, wherein the amount of glyoxal added is controlled to produce a ratio of cross direction wet tensile strength to cross direction dry tensile strength of over at least about 20%.

41. The tissue of claim 35, wherein the amount of glyoxal added is controlled to produce a ratio of cross direction wet tensile strength to cross direction dry tensile strength of over at least about 22%.

42. The tissue of claim 35, wherein processing and calendering of said tissue is controlled to produce a GM MMD friction of from about 0.120 to 0.175 and a modulus of from about 22.5 to 10 g/% strain.

43. The tissue of claim 35, wherein the tensile modulus of the tissue is controlled within the range of less than 32 g/% strain, and the GM MMD of the tissue is controlled to less than 0.23.

44. The tissue of claim 35, wherein the amount of glyoxal added is controlled such that the tensile modulus of the tissue is controlled within the range of less than 26 g/% strain, and the GM MMD of the tissue is controlled to less than 0.185.

45. The tissue of claim 35, wherein the amount of glyoxal added is controlled to produce a ratio of cross direction wet tensile strength to cross direction dry tensile strength of over at least about 24%.

46. The tissue of claim 35, wherein the ratio of machine direction dry tensile strength to cross direction dry tensile strength is no more than about 2.5.

47. The tissue of claim 35, wherein the ratio of machine direction dry tensile strength to cross direction dry tensile strength is no more than about 1.9.

48. The tissue of claim 35, wherein the ratio of machine direction dry tensile strength to cross direction dry tensile strength is between about 1.8 and about 2.5.

49. A dispersible tissue product having a glabrous surface and being adapted both for use in a dry condition and for use in a premoistened condition, said tissue having temporary wet strength and comprising glyoxal or aldehyde containing cyclic urea and mixtures thereof and cationic starch as water soluble temporary wet strength agents, the ratio of glyoxal or cyclic urea to the starch being controlled to produce an initial normalized CD wet tensile strength of at least about 75 g/3 inch strip 5 seconds after wetting as measured by the Finch Cup method; said tissue exhibiting a subsequent CD wet tensile, as measured 10 minutes after immersion, of less than about ½ of the initial CD wet tensile strength, said paper product in a moistened condition exhibiting a Wet Abrasion Resistance Number of at least about 4.

50. The tissue of claim 49, wherein the cationic starch is in the form of a water soluble cationic organic polymer having aldehyde groups in its moiety.

51. The tissue of claim 49, wherein the initial normalized CD wet tensile strength of said tissue is in excess of at least about 105 g/3 inch strip 5 seconds after immersion.

52. The tissue of claim 49, wherein the tensile modulus of the tissue is controlled within the range of less than 32 g/% strain, and the GM MMD of the tissue is controlled to less than 0.23.

53. The tissue of claim 23, wherein the wet abrasion resistance number of the tissue exceeds 8.

54. The tissue of claim 49, wherein the amount of the glyoxal or aldehyde containing cyclic urea and cationic starch added is controlled to produce a ratio of cross direction wet tensile strength to cross direction dry tensile strength of over at least about 22%.

55. A dispersible tissue product having a glabrous surface and being adapted both for use in a dry condition and for use in a premoistened condition, said tissue having temporary wet strength and comprising glyoxal as water soluble temporary wet strength agent, cationic starch as a strength enhancing agent and a cationic softener/debonder, the ratio of the glyoxal to the starch and the softener/debonder being controlled to produce an initial normalized CD wet tensile strength of at least about 75 g/3 inch strip 5 seconds after wetting as measured by the Finch Cup method; said tissue exhibiting a subsequent CD wet tensile, as measured 10 minutes after immersion, of less than about ½ of the initial CD wet tensile strength, said paper product in a moistened condition exhibiting a Wet Abrasion Resistance Number of at least 4.

56. The tissue of claim 55, wherein the tensile modulus of the tissue is controlled within the range of less than 32 g/% strain, and the GM MMD of the tissue is controlled to less than 0.23.

57. The tissue of claim 55 wherein the tensile modulus of the tissue is controlled within the range of less than 28 g/% strain, and the GM MMD of the tissue is controlled to less than 0.26.

58. The tissue of claim 55, wherein the initial normalized CD wet tensile strength of said tissue is in excess of at least about 105 g/3 inch strip 5 seconds after immersion.

59. The tissue of claim 55, wherein the cationic softener/debonder is chosen from the group consisting of imidazolines, amido amine salts, linear amido amines, tetravalent salts, ammonium salts and mixtures thereof.

60. A dispersible tissue product having a glabrous surface and being adapted both for use in a dry condition and for use in a premoistened condition, said tissue having temporary wet strength and comprising a water soluble temporary wet strength agent selected from the group consisting of uncharged aldehydes, aldehyde containing polymers, polyols and cyclic ureas and mixtures thereof and cationic nitrogen containing softeners/debonders and wherein the ratio of the water soluble temporary wet strength agent to the softener/debonder is controlled to produce an initial normalized CD wet tensile strength of at least about 75 g/3 inch strip 5 seconds after wetting as measured by the Finch Cup method; said tissue exhibiting a subsequent CD wet tensile, as measured 10 minutes after immersion, of less than about ½ of the initial CD wet tensile strength, said paper product in a moistened condition exhibiting a Wet Abrasion Resistance Number of at least about 4.

61. The tissue of claim 60, wherein the initial normalized CD wet tensile strength of said tissue is in excess of at least about 105 g/3 inch strip 5 seconds after immersion.

62. The tissue of claim 60, wherein the cationic softener/debonder is chosen from the group consisting of imidazolines, amido amine salts, linear amido amine, tetravalent salts, ammonium salts and mixtures thereof.

63. A dispersible towel product having a glabrous surface, said towel having temporary wet strength and comprising a water soluble temporary wet strength agent selected from the group consisting of uncharged aldehydes, polymers, polyols and cyclic ureas the amount of said water soluble temporary wet strength agent being sufficient to produce an initial normalized CD wet tensile strength of at least about 300 g/3 inch strip 5 seconds after wetting as measured by the Finch Cup method; said tissue exhibiting a subsequent CD wet tensile, as measured 10 minutes after immersion, of less than about ½ of the initial CD wet tensile strength, said paper product in a moistened condition exhibiting a Wet Abrasion Resistance Number of at least about 14.

64. The towel of claim 63, wherein the temporary wet strength agent is glyoxal.

65. The towel of claim 63, wherein the temporary wet strength agent is a water soluble polyol containing aldehyde group.

66. A dispersible towel product having a glabrous surface and being adapted both for use in a dry condition and for use in a premoistened condition, said towel having temporary wet strength and comprising a water soluble temporary wet strength agent selected from the group consisting of uncharged aldehydes, aldehyde containing polymers, polyols, and cyclic ureas, and mixtures thereof, a cationic starch and a cationic softener/debonder, the ratio of said water soluble temporary wet strength agent to the starch and the softener/debonder being sufficient to produce an initial normalized CD wet tensile strength of at least about 300 g/3 inch strip 5 seconds after wetting as measured by the Finch Cup method; said tissue exhibiting a subsequent CD wet tensile, as measured 10 minutes after immersion, of less than about ½ of the initial CD wet tensile strength, said paper product in a moistened condition exhibiting a Wet Abrasion Resistance Number of at least 14.

67. The towel of claim 66, wherein the water soluble strength enhancing agent is glyoxal.

68. A temporary wet strength paper product having a glabrous surface, said temporary wet strength paper product comprising from about 0% to about 100% by weight hardwood fiber, softwood fiber, recycle fiber, refined fiber or a mixture of these from about 2 pounds per ton to about 30 pounds per ton of a water-soluble temporary wet strength agent selected from the group of uncharged aldehydes, uncharged aldehyde containing polymers, polyols and cyclic ureas and mixtures thereof wherein the amount of the temporary wet strength agent is selected to yield an initial normalized CD wet tensile strength of greater than 105 g/3 inches as measured 10 minutes after immersion, an intermediate normalized CD wet tensile strength of less than ½ the initial value, said paper product in a moistened condition possessing substantial resistance to pilling and shredding when rubbed against pigskin.

69. The temporary wet strength paper product of claim 68, wherein the temporary wet strength agent is glyoxal.

70. A temporary wet strength paper product having a glabrous surface, said temporary wet strength paper product comprising from approximately 0% to about 100% by weight hardwood fiber, softwood fiber, recycle fiber, refined fiber or a mixture of these, from about 2 pounds per ton to about 30 pounds per ton of a water soluble temporary wet strength agent selected from the group of uncharged aldehydes, uncharged aldehyde containing polymers, polyols and cyclic ureas and about 2 pounds per ton to about 30 pounds per ton of cationic starch, wherein the ratio of the wet strength agent to cationic starch is selected to yield an initial normalized CD wet tensile strength of greater than 105 g/3 inch, an intermediate normalized CD wet tensile strength of less than ½ the initial value, said paper product in a moistened condition possessing substantial resistance to pilling and shredding when rubbed against pigskin.

71. The temporary wet strength paper product of claim 70, wherein the temporary wet strength agent is glyoxal.

72. A temporary wet strength paper product having a glabrous surface, said temporary wet strength paper product comprising from approximately 0% to approximately 100% by weight hardwood fiber, softwood fiber, recycle fiber, refined fiber or a mixture of these from about 2 pounds per ton to about 30 pounds per ton of a water soluble temporary wet strength agent selected from the group of (1) uncharged aldehydes, uncharged aldehyde containing polymers, polyols and cyclic ureas, and mixtures thereof and (2) cationic starches and (3) from about 1 pound per ton to about 10 pounds per ton of a cationic nitrogenous softener/debonder chosen from the group consisting of imidazolines, amido amine salts, linear amido amines, tetravalent ammonium salts and mixtures thereof, wherein the ratio of the temporary wet strength agent to the starch and to the nitrogenous cationic softener/debonder is selected to yield an initial normalized CD wet tensile strength of greater than 105 g/3 inch, as measured 10 minutes after immersion, an intermediate normalized CD wet tensile strength of less than ½ the initial value, said paper product in a moistened condition possessing substantial resistance to pilling and shredding when rubbed against pigskin.

73. The temporary wet strength paper product of claim 72, wherein the temporary wet strength agent is glyoxal.

74. A method of forming a paper product having a glabrous surface and being adapted for use in a dry condition and for use in a manually moistened condition comprising:

a) providing softwood fiber, hardwood fiber, recycle fiber, refined fiber or a mixture of these in an amount sufficient to form an overall furnish of from approximately 0% to 100% hardwood fiber, softwood fiber, recycle fiber, refined fiber or a mixture of these;

b) forming a cellulosic web from said furnish;

c) said web having an air side and a yankee side;

d) dewatering said web by overall compaction of said web;

e) adding a predetermined quantity of the uncharged strength enhancing agent selected from the group of uncharged aldehydes, uncharged aldehyde containing polymers, polyols and cyclic ureas and mixtures thereof to the web;

f) forming a paper product by drying the web on a Yankee dryer, wherein the paper product has an initial normalized CD wet tensile strength of greater than 75 g/3 inches as measured using the Finch Cup Test 5 seconds after immersion in water, said paper product exhibiting a Wet Abrasion Resistance Number of at least about 4.

75. The process of claim 74, wherein the wet strength enhancing agent is added on the airside of the web.

76. The process of claim 74, wherein the wet strength agent is added on the Yankee side of the web.

77. The process of claim 75, wherein the wet strength agent is added directly on the Yankee dryer surface.

78. The process of claim 75 or claim 76, wherein the unchanged wet strength agent is glyoxal or cyclic urea containing uncharged aldehyde moieties.

79. A method of forming a paper product having a glabrous surface and being adapted for use in a dry condition and for use in a manually moistened condition comprising:

a) providing softwood fiber, hardwood fiber, recycle fiber, refined fiber or a mixture of these in amounts sufficient to form an overall furnish of from approximately 0% to about 100% hardwood fiber, softwood fiber, recycle fiber, refined fiber or mixtures of these;

b) contacting said furnish with a predetermined quantity of starch in the range of approximately 1 pound per ton to 12 pounds per ton of fiber in the furnish;

c) forming a cellulosic web from said furnish; said web having an air side and a Yankee side;

d) dewatering said web by overall compaction of said web;

e) adding a predetermined quantity of the wet strength enhancing agent selected from the group consisting of uncharged aldehydes, uncharged aldehyde containing polymers, polyols and cyclic ureas or mixtures thereof to the web;

f) forming a paper product by drying the web on a Yankee dryer, wherein the paper product has an initial normalized CD wet tensile strength of greater than 75 g/3 inches as measured using the Finch Cup Test 5 seconds after immersion in water said paper product exhibiting a Wet Abrasion Resistance Number of at least about 4.

80. The process of claim 79, wherein the wet strength agent is added on the air side of the web.

81. The process of claim 79, wherein the wet strength agent is added on the Yankee side of the web.

82. The process of claim 80, wherein the wet strength agent is added directly on the Yankee dryer surface.

83. The process of claim 80 or claim 82, wherein the wet strength agent added is glyoxal.

84. A method of forming a paper product having a glabrous surface and being adapted for use in a dry condition and for use in a manually moistened condition comprising:

a) providing softwood fiber, hardwood fiber, recycle fiber, refined fiber or a mixture of these in amounts sufficient to form an overall furnish of from approximately 0% to 100% of hardwood fiber, softwood fiber, recycle fiber, refined fiber or a mixture of these;

b) contacting said furnish with a predetermined quantity of starch in the range of approximately 1 pound per ton to 12 pounds per ton of overall furnish;

c) subsequent to the addition of the starch to the fiber adding a predetermined quantity of a cationic nitrogenous softener/debonder chosen from the group consisting of imidazolines, amido amine salts, linear amine amides, tetravalent ammonium salts and mixtures thereof in the range of 1–4 pounds per ton of fiber in the furnish forming cellulosic web from said furnish;

d) said web having an air side and a Yankee side;

e) dewatering said web by overall compaction of said web;

f) adding a predetermined quantity of the wet strength agent, selected from the group consisting of uncharged aldehydes, uncharged aldehyde containing polymers, polyols, cyclic ureas or mixtures thereof to the web; forming a paper product by drying the web on a Yankee dryer, wherein the paper product has an initial normalized CD wet tensile strength of greater than 75 g/3 inches as measured using the Finch Cup Test 5 seconds after immersion in water said paper product exhibiting a Wet Abrasion Resistance Number of at least about 4.

85. The process of claim 84, wherein the wet strength agent is added on the air side of the web.

86. The process of claim 84, wherein the wet strength agent is added on the Yankee side of the web.

87. The process of claim 84, wherein the wet strength agent is added directly on the Yankee.

88. The process of claim 85, or claim 86 or claim 87, wherein the wet strength agent added is glyoxal.

89. The process of claim 84, wherein the cationic nitrogenous softener/debonder is added to the air side of the web.

90. A method of forming a paper product having a glabrous surface and being adapted for use in a dry condition and for use in a manually moistened condition comprising:

a) providing softwood fiber, hardwood fiber, recycle fiber, refined fiber or a mixture of these in an amount sufficient to form an overall furnish of from approximately 0% to 100% hardwood fiber, softwood fiber, recycle fiber, refined fiber or a mixture of these;

b) forming a cellulosic web from said furnish;

c) dewatering said web by overall compaction of said web;

d) partially drying the web on a yankee dryer, e) adding a predetermined quantity of the uncharged strength enhancing agent selected from the group of uncharged aldehydes, uncharged aldehyde containing polymers, polyols and cyclic ureas and mixtures thereof to the partially dried web which has a moisture content of at least 10 percent, f) forming a paper product by drying on one or more drying means to a moisture content of less than ten percent, wherein the paper product has an initial normalized CD wet tensile strength of greater than 75g/3 inches as measured using the Finch Cup Test 5 seconds after immersion in water, said paper product exhibiting a Wet Abrasion Resistance Number of at least about 4.

91. A method of forming a paper product adapted for use in a dry condition and for use in a manually moistened condition comprising:

a) forming a furnish including at least one of softwood fiber, hardwood fiber, recycle fiber, refined fiber or a mixture of these fibers;

b) forming a cellulosic web from said furnish;

c) dewatering said web by compaction of said web;

d) adding an uncharged strength enhancing agent selected from the group consisting of an uncharged aldehyde, an uncharged aldehyde containing polymer, a polyol, a cyclic urea and mixtures thereof to the web;

e) forming a paper product by drying the web on a Yankee dryer.

92. The method of claim 91, wherein the uncharged strength enhancing agent is added prior to removal of the web from the Yankee dryer.

93. A product produced by the method as claimed in claim 91.

94. The method of claim 91, wherein the web is formed on a through-air-dryer.

95. The method of claim 91, wherein the web is formed on a wet press.

96. A soft dispersible tissue product adapted both for use in a dry condition and for use in a premoistened condition, said tissue product having temporary wet strength and comprising a water soluble aldehyde containing temporary wet strength agent including an uncharged water soluble chemical moiety the amount of said water soluble temporary wet strength agent being sufficient to produce a paper product in a moistened condition exhibiting a Wet Abrasion Resistance Number of at least about 4.

97. A method of forming a paper product adapted for use in a dry condition and for use in a manually moistened condition comprising:

a) forming a furnish including at least one of softwood fiber, hardwood fiber, recycle fiber, refined fiber or a mixture of these fiber;

b) forming a cellulosic web from said furnish;

c) dewatering said web by compaction of said web;

d) partially drying the web to a moisture content of at least about 85 percent on a yankee dryer;

e) adding an uncharged strength enhancing agent selected from the group consisting of an uncharged aldehyde, and uncharged aldehyde containing polymer, a polyol, a cyclic urea and mixtures thereof to the partially dried web; and f) forming a paper product by drying said web, to a moisture content of less than ten percent on one or more drying means.

98. The process of claim 97 wherein the web is partially dried to a moisture content of about 35 to 85 percent on a yankee dryer.

99. A dispersible tissue product having a glabrous surface and being adapted both for use in a dry condition and for use in a premoistened condition, said tissue having temporary wet strength and comprising a water soluble aldehyde containing temporary wet strength agent including uncharged water soluble chemical moieties, the amount of said water soluble temporary wet strength agent being sufficient to produce an initial normalized CD wet tensile strength of at least about 100 g/3 inch strip 5 seconds after wetting as measured by the Finch Cup method; said tissue exhibiting a subsequent CD wet tensile, as measured 10 minutes after immersion, of less than about ½ of the initial CD wet tensile strength said paper product in a moistened condition exhibiting a Wet Abrasion Resistance Number of at least about 4 and a tensile modulus of less than 23g/% of strain.

100. A dispersible tissue product having a glabrous surface and being adapted both for use in a dry condition and for use in a premoistened condition, said tissue having temporary wet strength and comprising a water soluble aldehyde containing temporary wet strength agent including uncharged water soluble chemical moieties, the amount of said water soluble temporary wet strength agent being sufficient to produce an initial normalized CD wet tensile strength of at least about 100 g/3 inch strip 5 seconds after wetting as measured by the Finch Cup method; said tissue exhibiting a subsequent CD wet tensile, as measured 10 minutes after immersion, of less than about ½ of the initial CD wet tensile strength said paper product in a moistened condition exhibiting a Wet Abrasion Resistance Number of at least about 4, a surface friction of less than 0.15 GM MMD and a tensile modulus of less than 23/g% strain.

* * * * *

UNITED STATES PATENT AND TRADEMARK OFFICE

CERTIFICATE OF CORRECTION

PATENT NO.: 6,059,928

DATED: May 9, 2000

INVENTORS: Van Luu et al.

It is certified that an error appears in the above-identified patent and that said Letters Patent is hereby corrected as shown below:

Claim 97, col. 38, line 30, "these fiber" should read --these fibers--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*